US008814156B2

(12) United States Patent
Hattori

(10) Patent No.: US 8,814,156 B2
(45) Date of Patent: Aug. 26, 2014

(54) SHEET PROCESSING APPARATUS AND IMAGE FORMING SYSTEM

(71) Applicant: Fuji Xerox Co., Ltd., Tokyo (JP)

(72) Inventor: Nobuyoshi Hattori, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 2 days.

(21) Appl. No.: 13/675,261

(22) Filed: Nov. 13, 2012

(65) Prior Publication Data

US 2013/0313770 A1 Nov. 28, 2013

(30) Foreign Application Priority Data

May 25, 2012 (JP) ..... 2012-119185

(51) Int. Cl.
*B42C 1/00* (2006.01)

(52) U.S. Cl.
USPC .... 270/37; 270/58.07; 270/58.08; 270/58.14; 270/58.18; 399/407

(58) Field of Classification Search
CPC ..... B65H 37/04
USPC ..... 270/37, 58.07, 58.08, 58.14, 58.18; 399/407, 408, 410
See application file for complete search history.

(56) References Cited

U.S. PATENT DOCUMENTS

| | | | | |
|---|---|---|---|---|
| 7,306,214 | B2 * | 12/2007 | Iida et al. | 270/58.11 |
| 7,490,820 | B2 * | 2/2009 | Kobayashi | 270/37 |
| 7,581,725 | B2 * | 9/2009 | Fujita et al. | 270/58.17 |
| 8,292,283 | B2 * | 10/2012 | Matsuno et al. | 270/39.01 |
| 2011/0316215 | A1 * | 12/2011 | Matsuno et al. | 270/37 |

FOREIGN PATENT DOCUMENTS

| | | | |
|---|---|---|---|
| JP | 2004-277094 | A | 10/2004 |
| JP | 2006248762 | A * | 9/2006 |

* cited by examiner

*Primary Examiner* — Leslie A Nicholson, III
(74) *Attorney, Agent, or Firm* — Sughrue Mion, PLLC

(57) ABSTRACT

A sheet processing apparatus includes a feed-in path through which a sheet is fed, a first transport path through which a sheet fed from the feed-in path is transported, and a second transport path through which a sheet fed from the feed-in path is transported. The sheet processing apparatus also includes the following elements. A first processor sequentially stacks sheets output from the first transport path and performs first processing on a bundle of stacked sheets. A second processor sequentially stacks sheets output from the second transport path and performs second processing, which is different from the first processing, on a bundle of stacked sheets. A common retention path causes a sheet fed through the feed-in path to temporarily remain on the common retention path and causes the sheet temporarily remaining on the common retention path to be output to one of the first and second transport paths.

5 Claims, 17 Drawing Sheets

SHEET PROCESSING APPARATUS AND IMAGE FORMING SYSTEM

CROSS-REFERENCE TO RELATED APPLICATIONS

This application is based on and claims priority under 35 USC 119 from Japanese Patent Application No. 2012-119185 filed May 25, 2012.

BACKGROUND

Technical Field

The present invention relates to a sheet processing apparatus and an image forming system.

SUMMARY

According to an aspect of the invention, there is provided a sheet processing apparatus including: a feed-in path through which a sheet is fed; a first transport path through which a sheet fed from the feed-in path is transported; a first processor that sequentially stacks sheets output from the first transport path and that performs first processing on a bundle of stacked sheets; a second transport path through which a sheet fed from the feed-in path is transported; a second processor that sequentially stacks sheets output from the second transport path and that performs second processing, which is different from the first processing, on a bundle of stacked sheets; and a common retention path that causes a sheet fed through the feed-in path to temporarily remain on the common retention path and that causes the sheet temporarily remaining on the common retention path to be output to one of the first transport path and the second transport path.

BRIEF DESCRIPTION OF THE DRAWINGS

Exemplary embodiments of the present invention will be described in detail based on the following figures, wherein.

DETAILED DESCRIPTION

Exemplary embodiments of the invention will be described below in detail with reference to the accompanying drawings.

First Exemplary Embodiment

Figure 1:
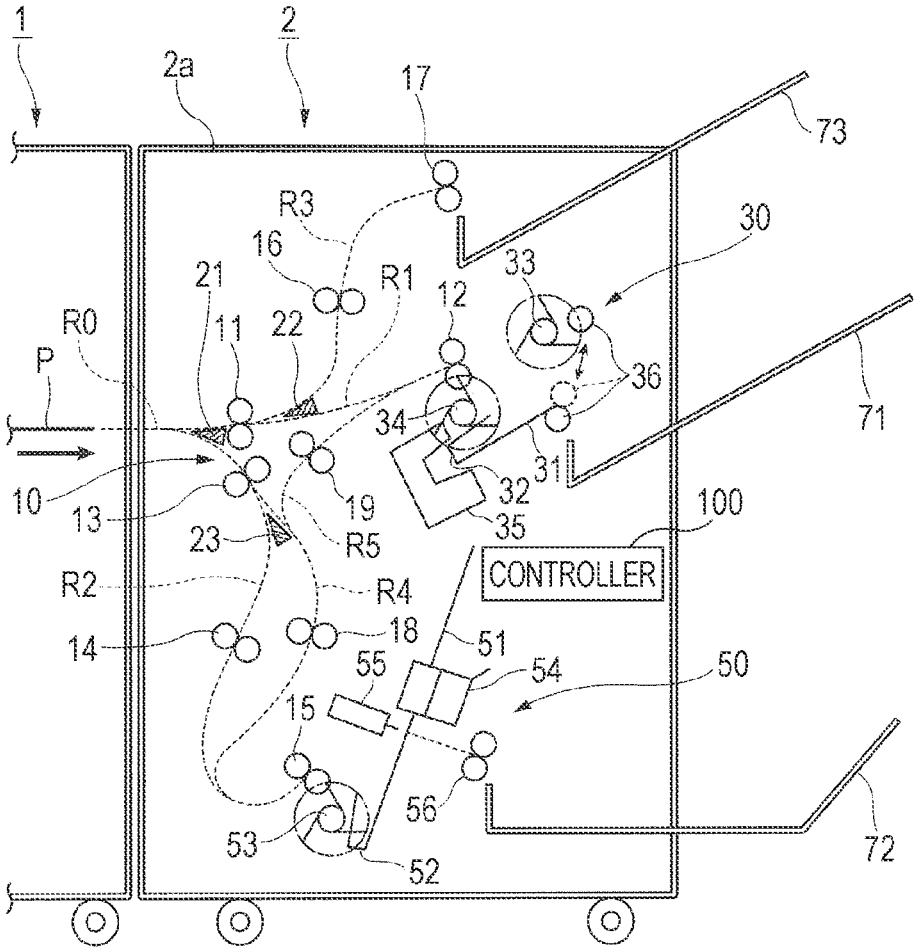
FIG. 1 illustrates an example of the entire configuration of an image forming system of a first exemplary embodiment.

FIG. 1 illustrates an example of the entire configuration of an image forming system of a first exemplary embodiment.

The image forming system includes an image forming apparatus 1 which forms an image on a sheet P and a post-processing apparatus 2 which performs post-processing on a sheet P on which an image is formed in the image forming apparatus 1 and sent from the image forming apparatus 1.

The image forming apparatus 1 of the first exemplary embodiment forms an image on a sheet P by using an electrophotographic system. However, the image forming apparatus 1 may form an image by using another system, such as an ink-jet system. Instead of using a direct-to-press printing system, such as an electrophotographic system or an ink-jet system, the image forming apparatus 1 may use an offset printing system. Additionally, when continuously printing a file including plural pages of image data items on plural sheets P and outputting them, the image forming apparatus 1 may change the order in which images are formed and reverse the front and back sides of a sheet P (and the forward and rear ends of the sheet P in the transport direction) after an image is formed on one side of the sheet P.

The post-processing apparatus 2, which is an example of a sheet processing apparatus, includes a sheet transport unit 10, an end binding processor 30, and a saddle stitch binding processor 50. The sheet transport unit 10 transports sheets P sent from the image forming apparatus 1. The end binding processor 30 sequentially stacks sheets P transported by the sheet transport unit 10 and also performs end binding processing on a bundle of stacked sheets P (hereinafter referred to as a "sheet bundle"). The saddle stitch binding processor 50 sequentially stacks sheets P transported by the sheet transport unit 10 and also performs saddle stitch binding processing on a sheet bundle. The post-processing apparatus 2 also includes first through third sheet stacking units 71 through 73, a controller 100, and a housing 2*a*. The first sheet stacking unit 71 stacks sheet bundles output from the end binding processor 30. The second sheet stacking unit 72 stacks sheet bundles output from the saddle stitch binding processor 50. The third sheet stacking unit 73 stacks sheets P which are transported by the sheet transport unit 10 and which are output without being subjected to end binding processing or saddle stitch binding processing. The controller 100 controls operations of the sheet transport unit 10, the end binding processor 30, and the saddle stitch binding processor 50. The housing 2*a* houses the above-described elements of the post-processing apparatus 2 therein. The controller 100 controls the post-processing apparatus 2 together with a controller (not shown) provided in the image forming apparatus 1.

In the post-processing apparatus 2, the saddle stitch binding processor 50 is positioned below the end binding processor 30. In the post-processing apparatus 2, the second sheet stacking unit 72 is positioned below the first sheet stacking unit 71, and the third sheet stacking unit 73 is positioned above the first sheet stacking unit 71.

In the post-processing apparatus 2, the sheet transport unit 10 includes a feed-in path R0, a first transport path R1, a second transport path R2, a third transport path R3, a fourth transport path R4, and a fifth transport path R5. The feed-in path R0 is connected to a sheet output section of the image forming apparatus 1 and receives sheets P from the image forming apparatus 1. The first transport path R1 is connected to the downstream end of the feed-in path R0 in the direction in which sheets P are transported, and guides sheets P fed from the feed-in path R0 to the end binding processor 30. The second transport path R2 is connected to the downstream end of the feed-in path R0 and branches off from the feed-in path R0 in a direction different from that of the first transport path R1. The second transport path R2 guides sheets P fed from the feed-in path R0 to the saddle stitch binding processor 50. The third transport path R3 branches off from a midway portion of the first transport path R1 and guides sheets P fed from the feed-in path R0 and the first transport path R1 to the third sheet stacking unit 73. The fourth transport path R4, which is an example of a common retention path, branches off from the upstream side of the second transport path R2 and joins the downstream side of the second transport path R2. The fifth transport path R5, which is an example of a connection transport path, branches off from a midway portion of the fourth transport path R4 and joins a midway portion of the first transport path R1. In the first exemplary embodiment, the second transport path R2 is positioned below the first transport path R1, and the third transport path R3 is positioned above the first transport path R1.

The sheet transport unit 10 includes first through ninth transport rollers 11 through 19. The first transport rollers 11 are provided on the farther upstream side than the portion at which the third transport path R3 branches off from the first transport path R1 in the transport direction of sheets P. The second transport rollers 12 are provided on the most downstream side of the first transport path R1 in the transport direction of sheets P. The third transport rollers 13 are provided on the farther upstream side than the portion at which the fourth transport path R4 branches off from the second transport path R2 in the transport direction of sheets P. The fourth transport rollers 14 are provided on the farther downstream side than the portion at which the fourth transport path R4 branches off from the second transport path R2 in the transport direction of sheets P and on the upstream side than the portion at which the fourth transport path R4 joins the second transport path R2 in the transport direction of sheets P. The fifth transport rollers 15 are provided on the most downstream side of the second transport path R2 in the transport direction of sheets P. The sixth transport rollers 16 are provided on the third transport path R3. The seventh transport rollers 17 are provided on the most downstream side of the third transport path R3 in the transport direction of sheets P. The eighth transport rollers 18 are provided on the fourth transport path R4. The ninth transport rollers 19 are provided on the fifth transport path R5.

The sheet transport unit 10 also includes first through third gates 21 through 23. The first gate 21 is positioned at a portion at which the second transport path R2 branches off from the first transport path R1. The second gate 22 is positioned at a portion at which the third transport path R3 branches off from the first transport path R1. The third gate 23 is positioned at a portion at which the fourth transport path R4 branches off from the second transport path R2. The first gate 21 is rotatable around a shaft (not shown) and is located at a position at which it can feed a sheet P supplied from the feed-in path R0 to one of the first and second transport paths R1 and R2. The second gate 22 is also rotatable around a shaft (not shown) and is located at a position at which it can feed a sheet P supplied from the upstream side of the first transport path R1 to one of the downstream side of the first transport path R1 and the third transport path R3. The third gate 23 is also rotatable around a shaft (not shown) and is located at a position at which it can feed a sheet P supplied from the upstream side of the second transport path R2 to one of the downstream side of the second transport path R2 and the fourth transport path R4. The third gate 23 also has a function of blocking the fourth transport path R4 at the portion at which the fifth transport path R5 branches off from the fourth transport path R4 when feeding a sheet P from the fourth transport path R4 to the fifth transport path R5.

In the post-processing apparatus 2, the end binding processor 30, which is an example of a first processor, includes an end-binding sheet stacking section 31, an end-binding sheet abutting section 32, a first end-binding paddle 33, a second end-binding paddle 34, an end binding stapler 35, and end binding output rollers 36. Sheets P output from the first transport path R1 through the second transport rollers 12 are sequentially stacked in the end-binding sheet stacking section 31. One end of each of sheets P stacked in the end-binding sheet stacking section (rear end of each of sheets P output from the first transport path R1 in the transport direction) abuts against the end-binding sheet abutting section 32. The first and second end-binding paddles 33 and 34 are rotatable and transport sheets P stacked in the end-binding sheet stacking section 31 to the end-binding sheet abutting section 32. The end binding stapler 35 is located adjacent to the end-binding sheet abutting section 32 and performs binding processing by stapling one end (which is near the end-binding sheet abutting section 32) of a sheet bundle stacked in the end-binding sheet stacking section 31. The end binding output rollers 36 output a sheet bundle stacked in the end-binding sheet stacking section 31 to the first sheet stacking unit 71. The end binding output rollers 36 include a first roller disposed below the end-binding sheet stacking section 31 and a second roller which is disposed above the end-binding sheet stacking section 31 and which is movable close to and away from the first roller. The end binding processor 30 also includes a tamper (not shown) which aligns the width direction (which intersects with the transport direction) of sheets P stacked in the end-binding sheet stacking section 31.

In the post-processing apparatus 2, the saddle stitch binding processor 50, which is an example of a second processor, includes a saddle-stitch-binding sheet stacking section 51, a saddle-stitch-binding sheet abutting section 52, a saddle stitch binding paddle 53, a saddle stitch binding stapler 54, a folding processor 55, and a saddle stitch binding output roller 56. Sheets P output from the second transport path R2 through the fifth transport rollers 15 are sequentially stacked in the saddle-stitch-binding sheet stacking section 51. One end of each of sheets P stacked in the saddle-stitch-binding sheet stacking section (rear end of each of sheets P output from the second transport path R2 in the transport direction) abuts against the saddle-stitch-binding sheet abutting section 52. The saddle stitch binding paddle 53 is rotatable and transports sheets P stacked in the saddle-stitch-binding sheet stacking section 51 to the saddle-stitch-binding sheet abutting section 52. The saddle stitch binding stapler 54 opposes the saddle-stitch-binding sheet stacking section 51 and performs binding processing by stapling a central portion (in the transport direction) of a sheet bundle stacked in the saddle-stitch-binding sheet stacking section 51. The folding processor 55 performs two-folding processing for folding a sheet bundle, which has been subjected to binding processing by using the saddle stitch binding stapler 54, into two with respect to the central portion of the sheet bundle. The saddle stitch binding output rollers 56 output a sheet bundle subjected to binding processing and two-folding processing to the second sheet stacking unit 72. The saddle stitch binding processor 50 also includes a tamper (not shown) which aligns the width direction (which intersect with the transport direction) of sheets P stacked in the saddle-stitch-binding sheet stacking section 51. As described above, the saddle stitch binding processor 50 has a function of binding and outputting a sheet bundle (saddle stitch binding function) by performing binding processing by stapling a central portion of the sheet bundle and by performing two-folding processing for folding the sheet bundle with respect to the central portion.

In the post-processing apparatus 2 of the first exemplary embodiment, one of the "end binding processing", which is an example of first processing, "saddle stitch bookbinding processing", which is an example of second processing, and "non-binding processing" is selectively performed. In the end binding processing, the sheet transport unit 10 sequentially supplies sheets P fed from the image forming apparatus 1 to the end binding processor 30, and the end binding processor 30 performs end binding processing on a sheet bundle constituted by the sheets P and outputs the sheet bundle to the first sheet stacking unit 71. In the saddle stitch binding processing, the sheet transport unit 10 sequentially supplies sheets P fed from the image forming apparatus 1 to the saddle stitch binding processor 50, and the saddle stitch binding processor 50 performs saddle stitch binding processing and two-folding processing on a sheet bundle constituted by the sheets P and outputs the sheet bundle to the second sheet stacking unit 72. In the non-binding processing, the sheet transport unit 10 outputs sheets P fed from the image forming apparatus 1 to the third sheet stacking unit 73 without performing any processing.

In the end binding processing, one of "end-binding direct output processing" and "end-binding indirect output processing" is performed. In the end-binding direct output processing, sheets P are output from the feed-in path R0 to the end binding processor 30 via the first transport path R1. In the end-binding indirect output processing, sheets P are output from the feed-in path R0 to the end binding processor 30 via the second transport path R2, the fourth transport path R4, the fifth transport path R5, and the first transport path R1.

In the saddle stitch bookbinding processing, one of "saddle-stitch-binding direct output processing" and "saddle-stitch-binding indirect output processing" is performed. In the saddle-stitch-binding direct output processing, sheets P are output from the feed-in path R0 to the saddle stitch binding processor 50 via the second transport path R2. In the saddle-stitch-binding indirect output processing, sheets P are output from the feed-in path R0 to the saddle stitch binding processor 50 via the second transport path R2, the fourth transport path R4, and the second transport path R2.

In the non-binding processing, "non-binding output processing" is performed in which sheets P are output from the feed-in path R0 to the third sheet stacking unit 73 via the first transport path R1 and the third transport path R3.

Procedures for transporting sheets P in the above-described end-binding direct output processing, end-binding indirect output processing, saddle-stitch-binding direct output processing, saddle-stitch-binding indirect output processing, and non-binding output processing will be described below in this order.

Figure 2:
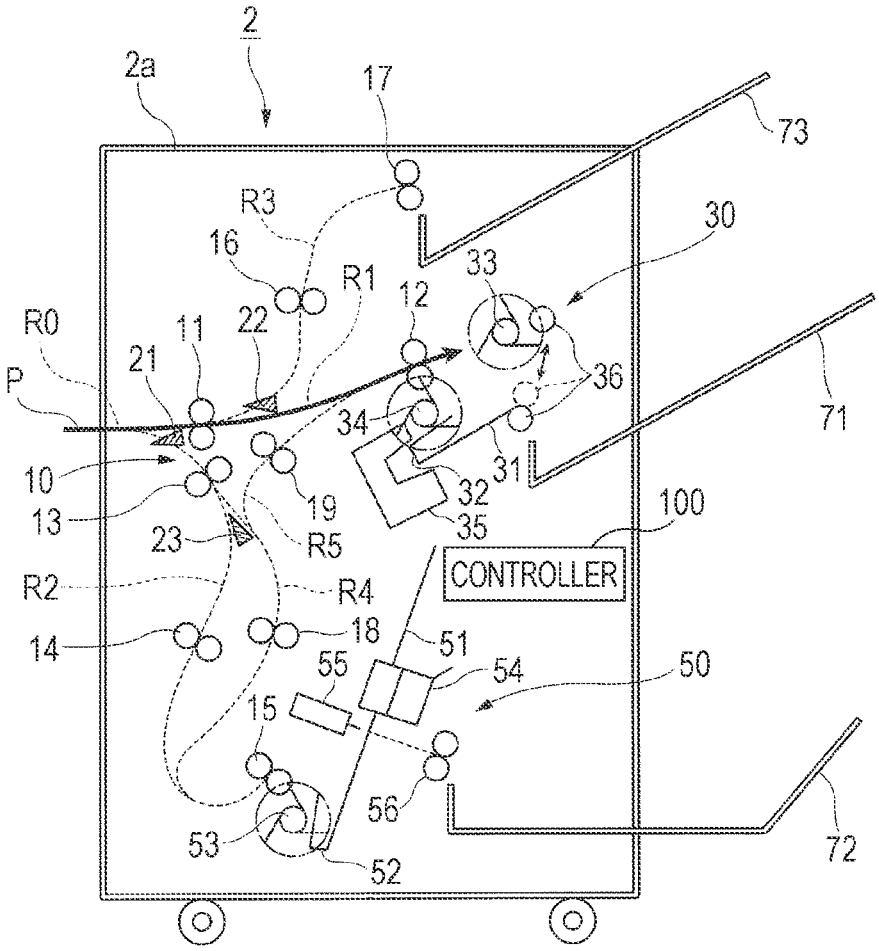
FIG. 2 illustrates a procedure of end-binding direct output processing in a post-processing apparatus of the first exemplary embodiment.

FIG. 2 illustrates a procedure of the end-binding direct output processing in the post-processing apparatus 2 of the first exemplary embodiment.

In the end-binding direct output processing, the first gate 21 is located at a position at which the feed-in path R0 and the first transport path R1 are connected (the feed-in path R0 and the second transport path R2 are disconnected), and the second gate 22 is located at a position at which the upstream side and the downstream side of the first transport path R1 are connected (the upstream side of the first transport path R1 and the third transport path R3 are disconnected). In the end-binding direct output processing, the sheet P does not pass through the mounting position of the third gate 23.

In the end-binding direct output processing, the sheet P supplied from the feed-in path R0 is output to the end binding processor 30 via the first transport rollers 11 and the second transport rollers 12 provided on the first transport path R1, as indicated by the thick arrow in FIG. 2.

FIGS. 3A through 3D illustrate a procedure of the end-binding indirect output processing in the post-processing apparatus 2 of the first exemplary embodiment.

Figure 3B:
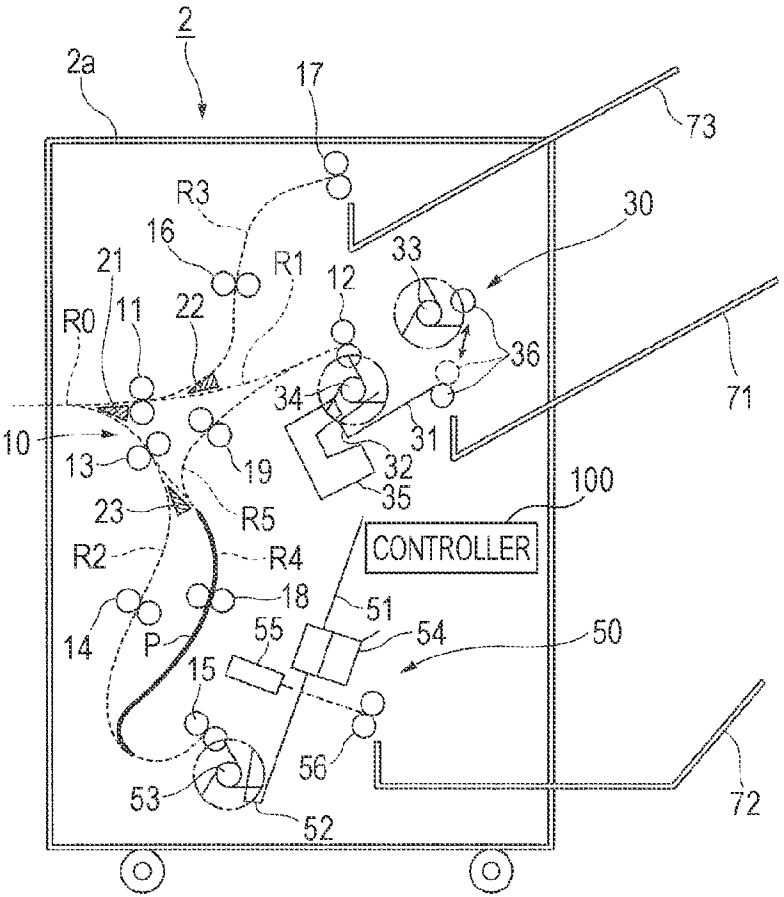
FIGS. 3A through 3D illustrate a procedure of end-binding indirect output processing in the post-processing apparatus of the first exemplary embodiment.
Figure 3A:
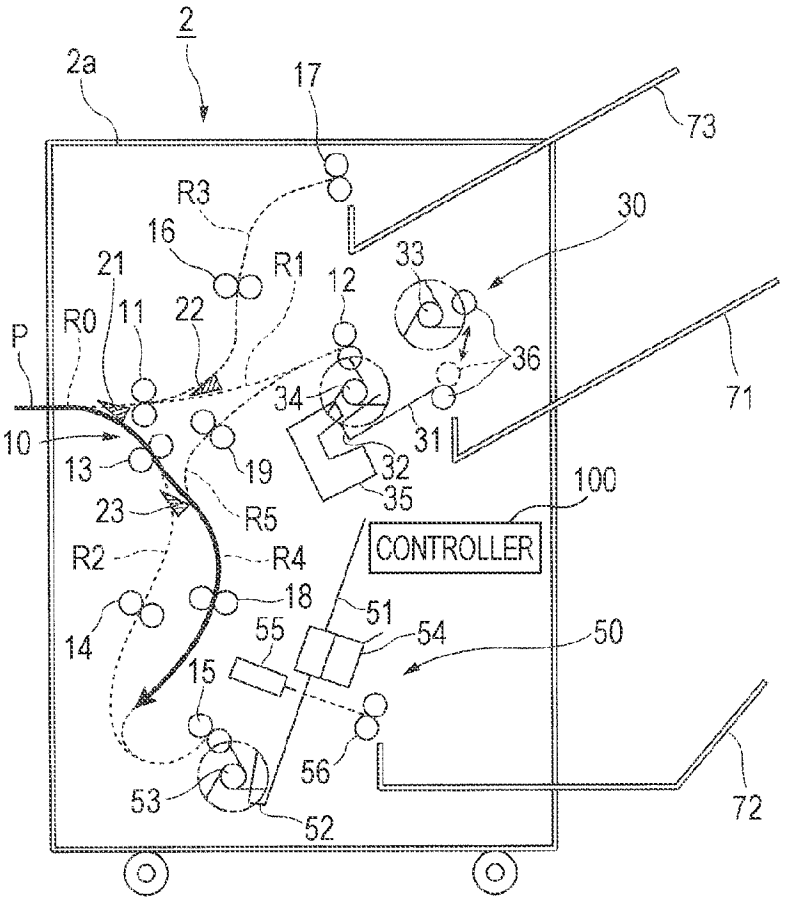

FIG. 3A illustrates a first state (the state in which a sheet P is fed from the image forming apparatus 1 via the feed-in path R0) of the end-binding indirect output processing. In the first state, the first gate 21 is located at a position at which the feed-in path R0 and the second transport path R2 are connected (the feed-in path R0 and the first transport path R1 are disconnected), and the third gate 23 is located at a position at which the upstream side of the second transport path R2 and the fourth transport path R4 are connected (the upstream side and the downstream side of the second transport path R2 are disconnected). In the end-binding indirect output processing, the sheet P does not pass through the mounting position of the second gate 22.

In the first state, the sheet P fed from the image forming apparatus 1 via the feed-in path R0 is input into the fourth transport path R4 via the second transport path R2 through the third transport rollers 13 provided on the second transport path R2 and the eighth transport rollers 18 provided on the fourth transport path R4, as indicated by the thick arrow in FIG. 3A. Then, after the rear end of the sheet P passes through the portion at which the fifth transport path R5 branches off from the fourth transport path R4, the rotation of the eighth transport rollers 18 is stopped.

FIG. 3B illustrates a second state (the state in which the sheet P remains in the fourth transport path R4) after the first state shown in FIG. 3A in the end-binding indirect output processing. In the second state, both of the forward and rear ends of the sheet P in the transport direction are located in the fourth transport path R4.

Figure 3D:
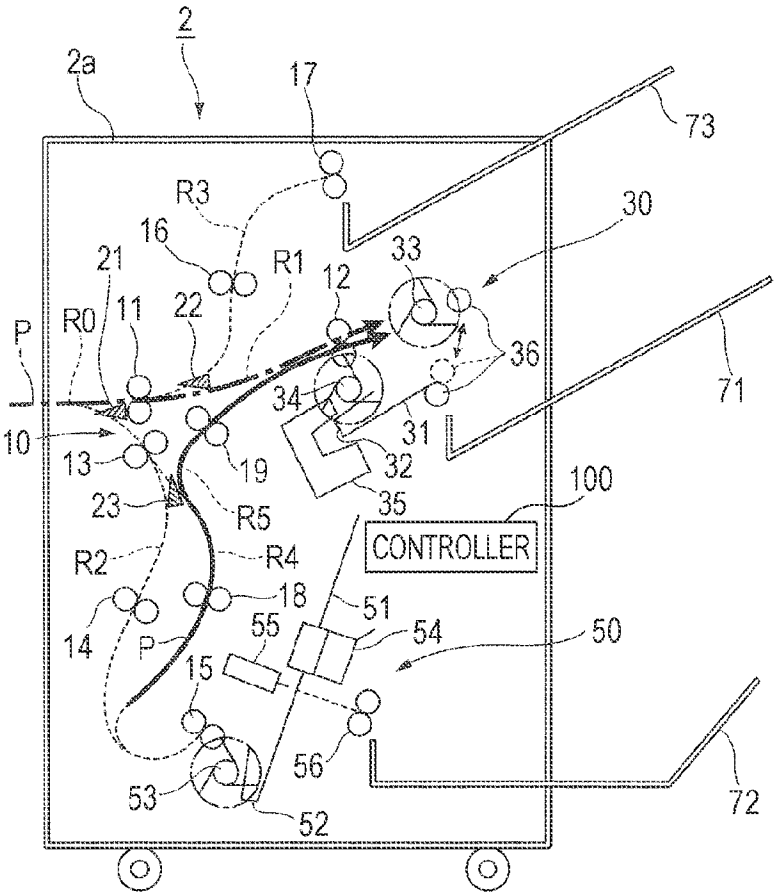
Figure 3C:
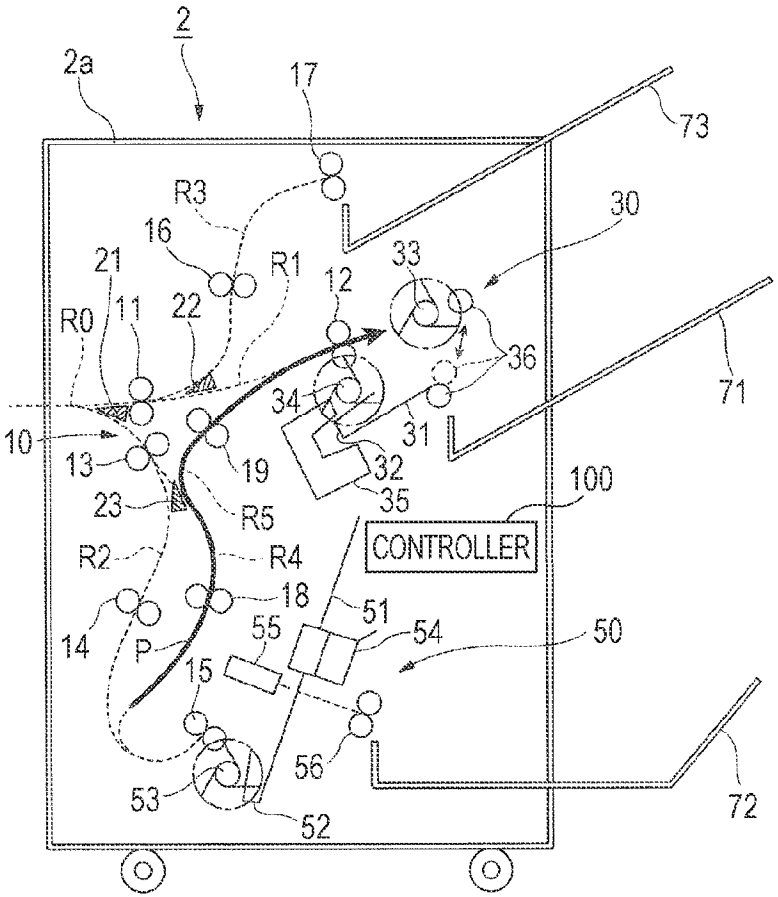

FIG. 3C illustrates a third state (the state in which the sheet P is fed out from the fourth transport path R4) after the second state shown in FIG. 3B in the end-binding indirect output processing. In the third state, the third gate 23 is located at a position at which the downstream side of the fourth transport path R4 and the fifth transport path R5 are connected (the downstream side and the upstream side of the fourth transport path R4 are disconnected).

In the third state, the eighth transport rollers 18 provided on the fourth transport path R4 are rotated in a direction opposite to the direction in which the sheet P is fed into the post-processing apparatus 2, thereby causing the sheet P to be transported in a direction opposite to the direction in which the sheet P is fed into the post-processing apparatus 2. Accordingly, the sheet P is transported from the fourth transport path R4 to the fifth transport path R5, as indicated by the thick arrow in FIG. 3C, and are output to the end binding processor 30 via the ninth transport rollers 19 provided on the fifth transport path R5 and the second transport rollers 12 provided on the first transport path R1.

In the example shown in FIG. 3C, the sheet P which is transported to the fourth transport path R4 is singly output to the end binding processor 30. However, as shown in FIG. 3D, in accordance with the timing at which the next sheet P (indicated by the long dashed dotted arrow in FIG. 3D) is subjected to the end-binding direct output processing through the first transport path R1, the sheet P (indicated by the solid arrow in FIG. 3D) transported via the fourth transport path R4 may be output to the end binding processor 30. In this case, two sheets P are output to the end binding processor 30 in the state in which they are superposed on each other.

Figure 4:
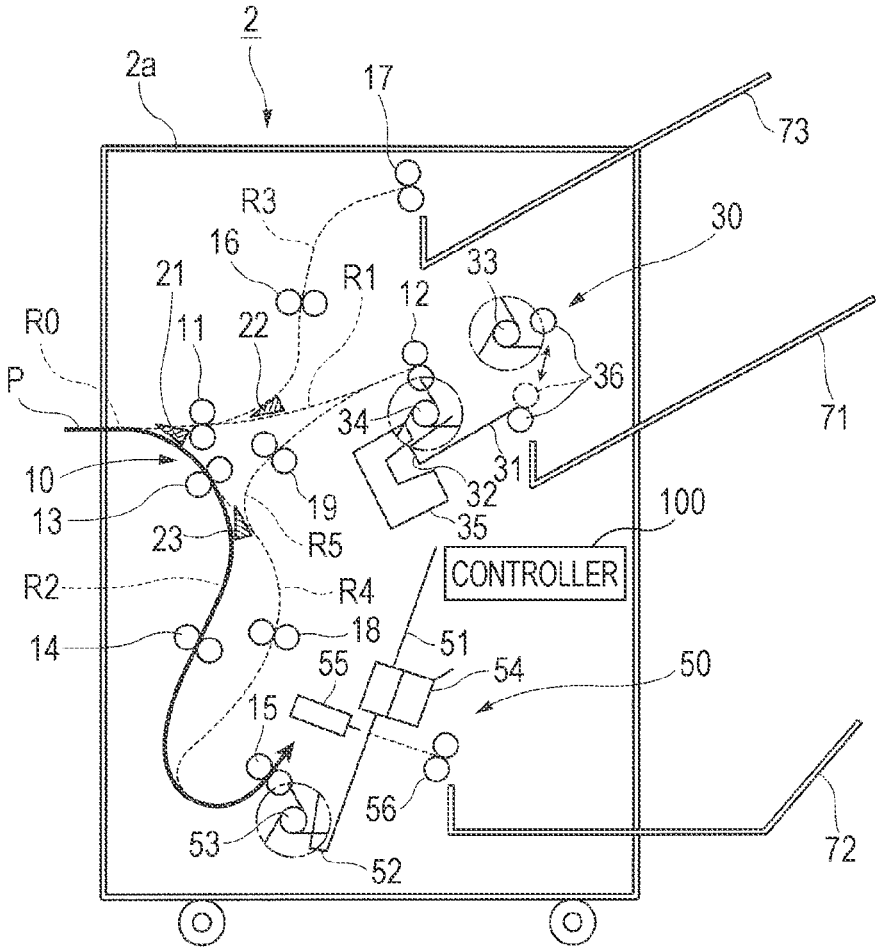
FIG. 4 illustrates a procedure of saddle-stitch-binding direct output processing in the post-processing apparatus of the first exemplary embodiment.

FIG. 4 illustrates a procedure of saddle-stitch-binding direct output processing in the post-processing apparatus 2 of the first exemplary embodiment.

In the saddle-stitch-binding direct output processing, the first gate 21 is located at a position at which the feed-in path R0 and the second transport path R2 are connected (the feed-in path R0 and the first transport path R1 are disconnected), and the third gate 23 is located at a position at which the upstream side and the downstream side of the second transport path R2 are connected (the upstream side of the second transport path R2 and the fourth transport path R4 are disconnected). In the saddle-stitch-binding direct output processing, the sheet P does not pass through the mounting position of the second gate 22.

In the saddle-stitch-binding direct output processing, the sheet P fed from the feed-in path R0 is output to the saddle stitch binding processor 50 via the third transport rollers 13, the fourth transport rollers 14, and the fifth transport rollers 15 provided on the second transport path R2.

FIGS. 5A through 5D illustrate a procedure of saddle-stitch-binding indirect output processing in the post-processing apparatus 2 of the first exemplary embodiment.

Figure 5B:
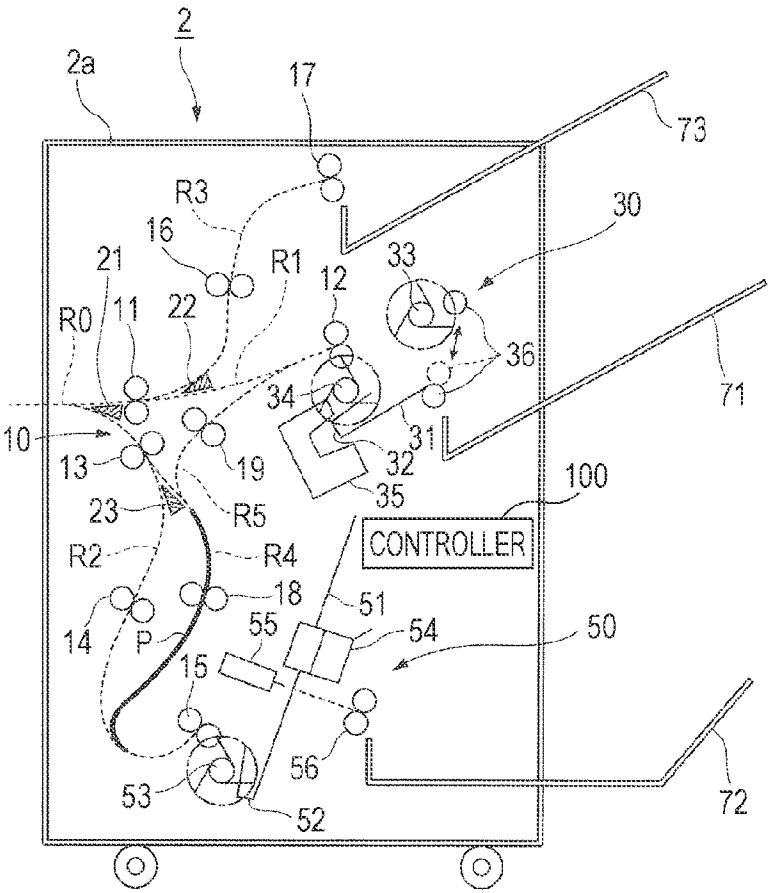
FIGS. 5A through 5D illustrate a procedure of saddle-stitch-binding indirect output processing in the post-processing apparatus of the first exemplary embodiment.
Figure 5A:
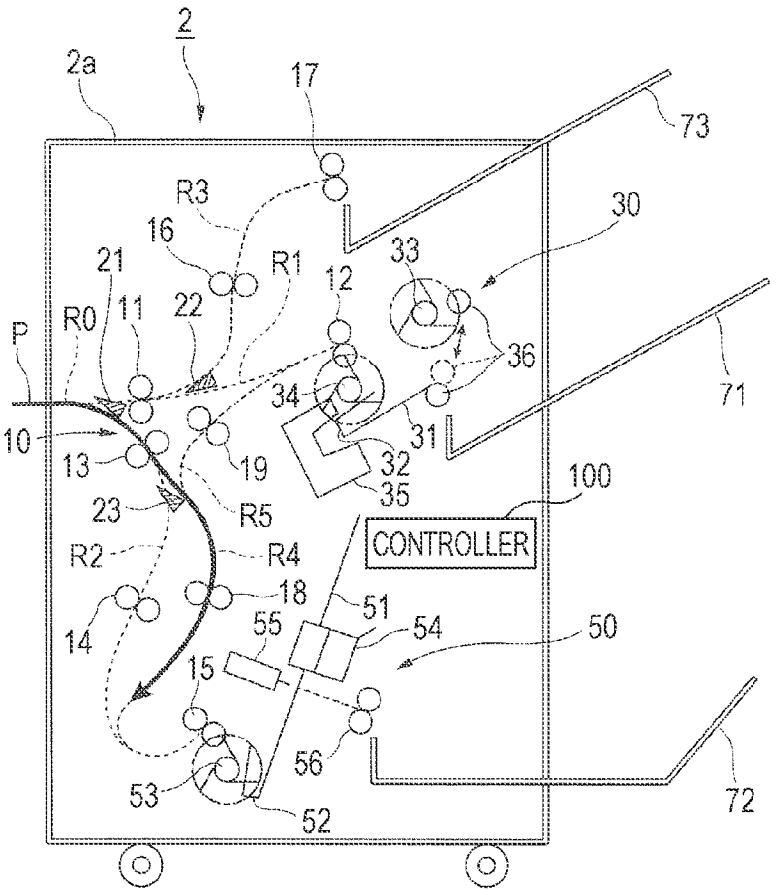

FIG. 5A illustrates a first state (the state in which a sheet P is fed from the image forming apparatus 1 via the feed-in path R0) of the saddle-stitch-binding indirect output processing. In the first state, the first gate 21 is located at a position at which the feed-in path R0 and the second transport path R2 are connected (the feed-in path R0 and the first transport path R1 are disconnected), and the third gate 23 is located at a position at which the upstream side of the second transport path R2 and the fourth transport path R4 are connected (the upstream side and the downstream side of the second transport path R2 are disconnected). In the saddle-stitch-binding indirect output processing, the sheet P does not pass through the mounting position of the second gate 22.

In the first state, the sheet P fed from the image forming apparatus 1 through the feed-in path R0 is input into the fourth transport path R4 via the second transport path R2 through the third transport rollers 13 provided on the second transport path R2 and the eighth transport rollers 18 provided on the fourth transport path R4, as indicated by the thick arrow in FIG. 5A. Then, after the rear end of the sheet P passes through the portion at which the fourth transport path R4 branches off from the second transport path R2, the rotation of the eighth transport rollers 18 is stopped.

FIG. 5B illustrates a second state (the state in which the sheet P remains in the fourth transport path R4) after the first state shown in FIG. 5A in the saddle-stitch-binding indirect output processing. In the second state, both of the forward and rear ends of the sheet P in the transport direction are located in the fourth transport path R4.

Figure 5D:
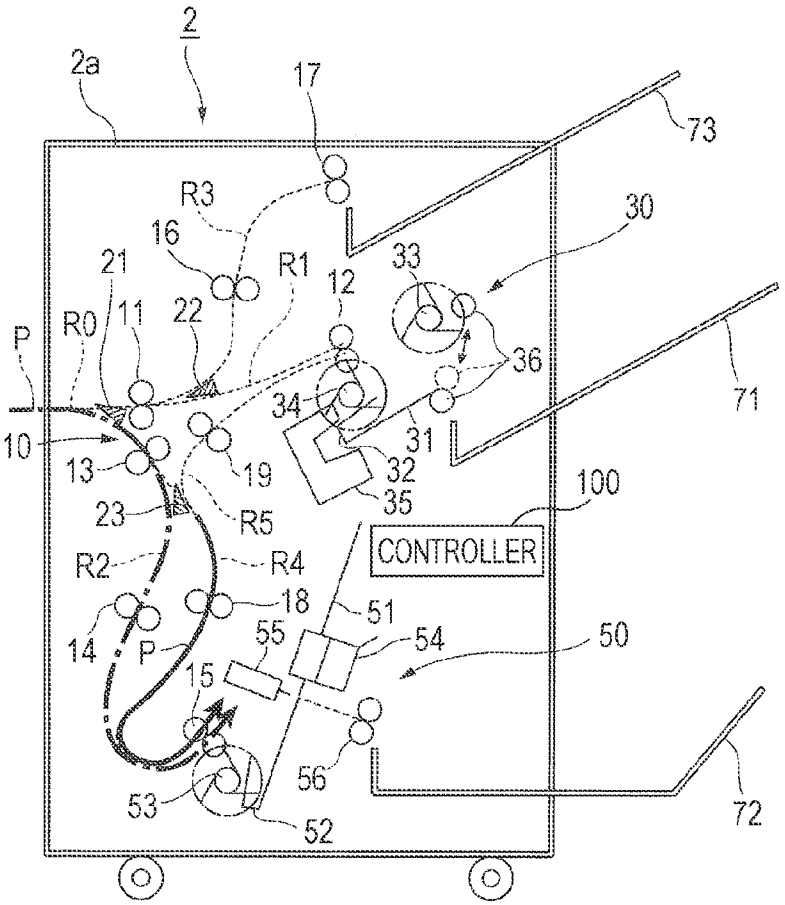
Figure 5C:
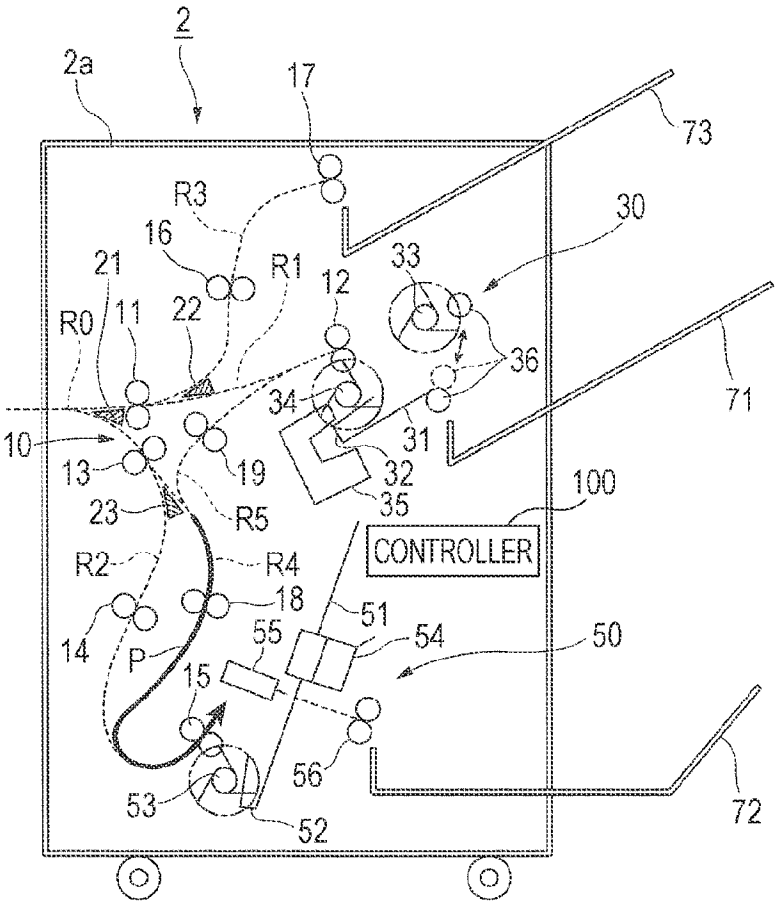

FIG. 5C illustrates a third state (the state in which the sheet P is fed out from the fourth transport path R4) after the second state shown in FIG. 5B in the saddle-stitch-binding indirect output processing.

In the third state, the eighth transport rollers 18 provided on the fourth transport path R4 are rotated in the same direction as that when the sheet P is fed into the post-processing apparatus 2, thereby causing the sheet P to be transported in the same direction as that when the sheet P is fed into the post-processing apparatus 2. Accordingly, the sheet P is transported from the fourth transport path R4 to the second transport path R2, as indicated by the thick arrow in FIG. 5C, and is output to the saddle stitch binding processor 50 via the fifth transport rollers 15 provided on the second transport path R2.

In the example shown in FIG. 5C, the sheet P which is transported to the fourth transport path R4 is singly output to the saddle stitch binding processor 50. However, as shown in FIG. 5D, in accordance with the timing at which the next sheet P (indicated by the long dashed dotted arrow) is subjected to saddle-stitch-binding direct output processing through the second transport path R2, the sheet P (indicated by the solid arrow in FIG. 5D) transported via the fourth transport path R4 may be output to the saddle stitch binding processor 50. In this case, two sheets P are output to the saddle stitch binding processor 50 in the state in which they are superposed on each other.

Figure 6:
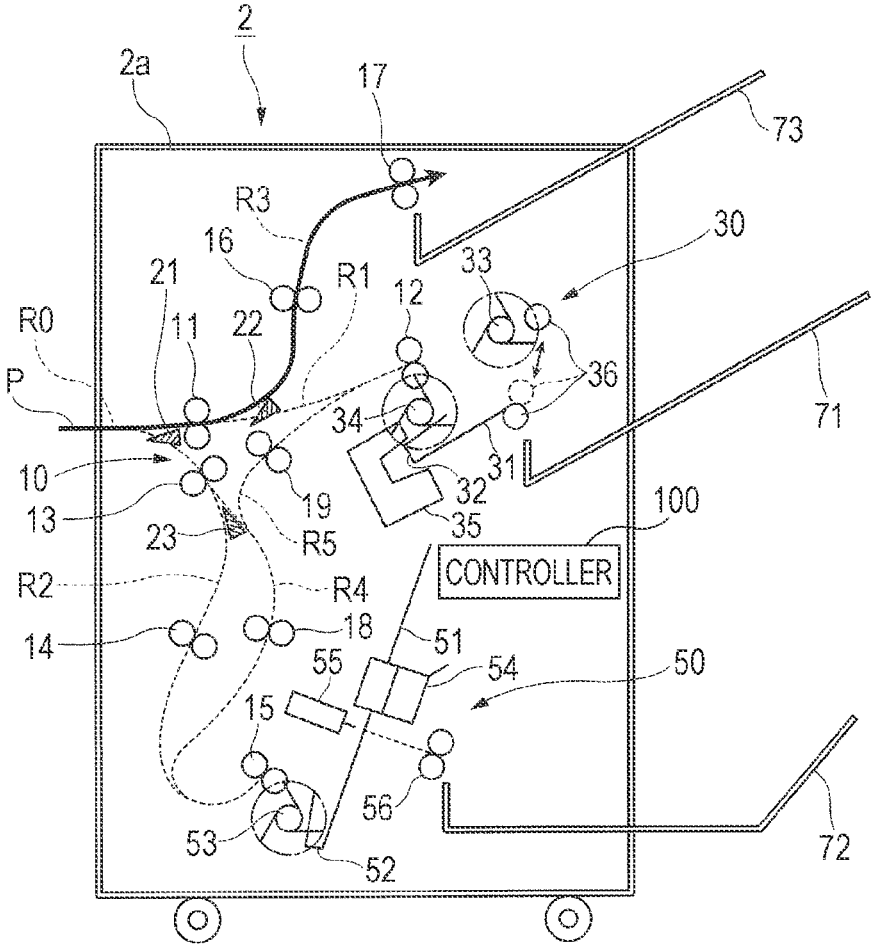
FIG. 6 illustrates a procedure of non-binding output processing in the post-processing apparatus of the first exemplary embodiment.

FIG. 6 illustrates a procedure of non-binding output processing in the post-processing apparatus 2 of the first exemplary embodiment.

In the non-binding output processing, the first gate 21 is located at a position at which the feed-in path R0 and the first transport path R1 are connected (the feed-in path R0 and the second transport path R2 are disconnected), and the second gate 22 is located at a position at which the upstream side of the first transport path R1 and the third transport path R3 are connected (the upstream side and the downstream side of the first transport path R1 are disconnected). In the non-binding output processing, the sheet P does not pass through the mounting position of the third gate 23.

In the non-binding output processing, the sheet P supplied through the feed-in path R0 is output to the third sheet stacking unit 73 via the first transport rollers 11 provided on the first transport path R1 and the sixth and seventh transport rollers 16 and 17 provided on the third transport path R3.

End-binding processing and saddle stitch bookbinding processing performed by the post-processing apparatus 2 of the first exemplary embodiment will be each described below through specific examples.

Figure 7:
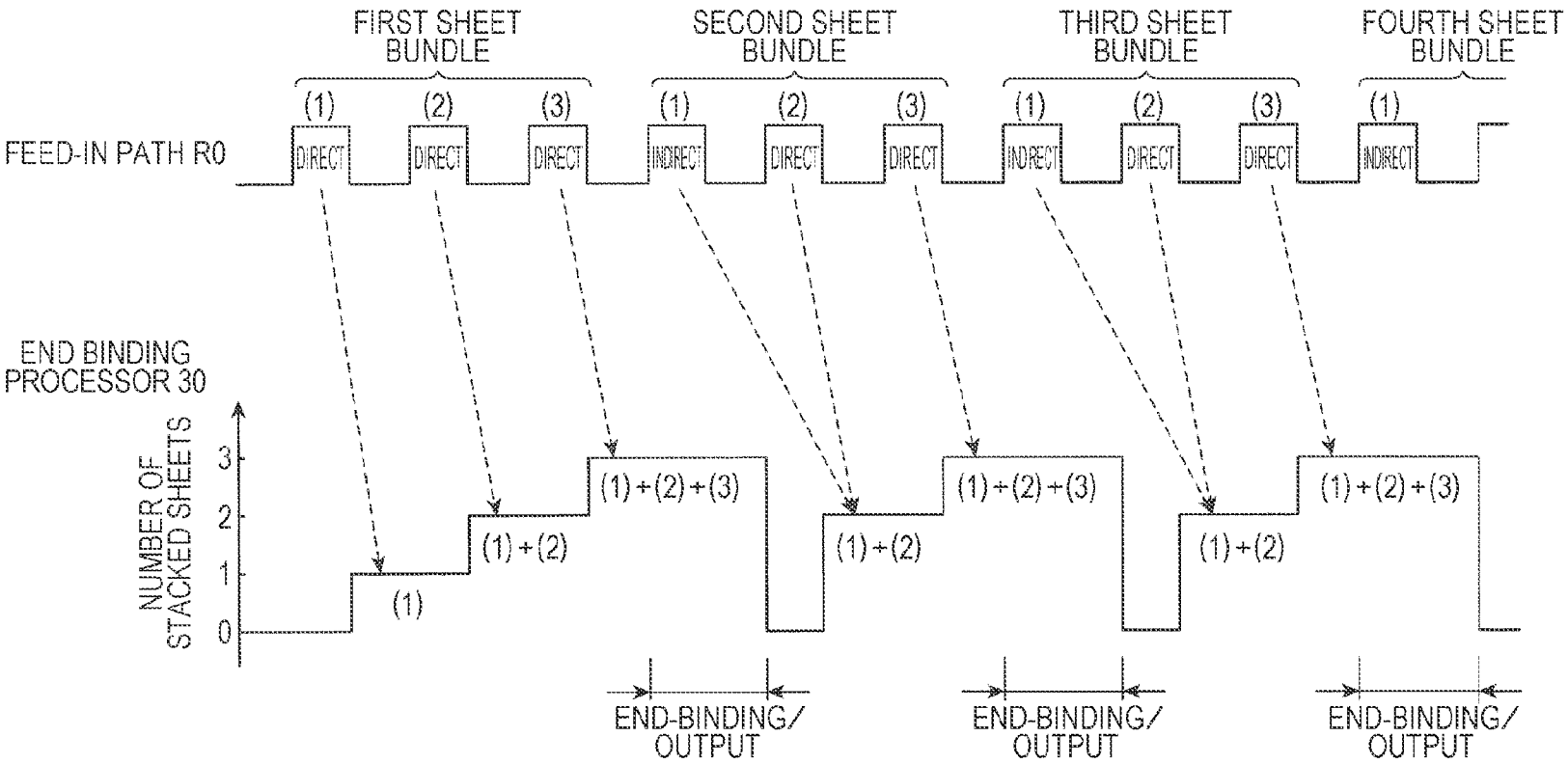
FIG. 7 is a timing chart illustrating an example of a procedure of end binding processing.

FIG. 7 is a timing chart illustrating an example of a procedure of end binding processing. In FIG. 7, the top section indicates sheets P passing through the feed-in path R0, and the bottom section indicates the number of sheets P stacked in the end binding processor 30 (and more specifically, the end-binding sheet stacking section 31). In this example, it is assumed that three sheets P form one sheet bundle and that each sheet bundle is subjected to end binding processing and is output.

Figure 8:
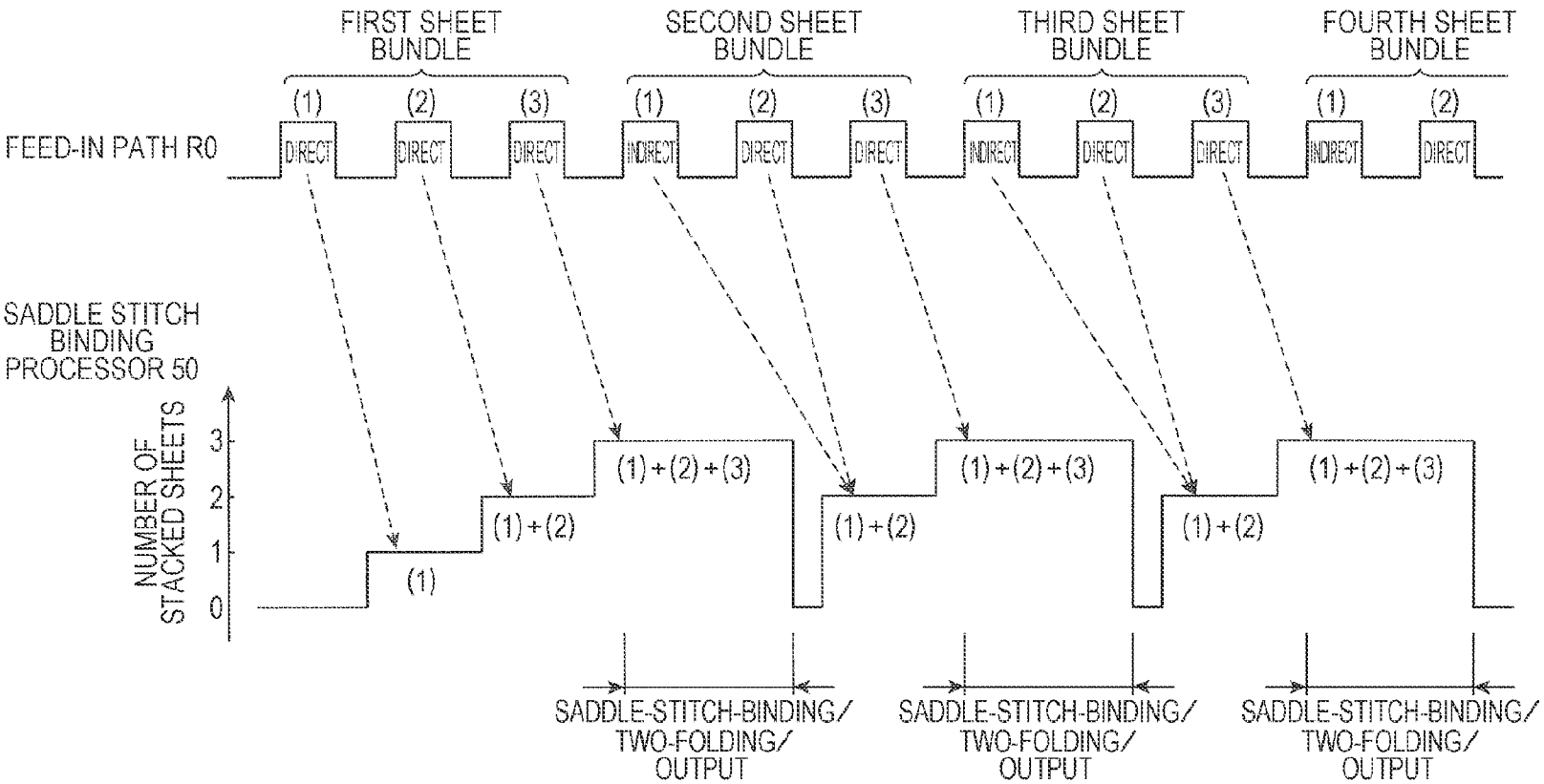
FIG. 8 is a timing chart illustrating an example of a procedure of saddle stitch bookbinding processing.

The first sheet P (indicated by (1) in FIG. 7, and the first sheets of other sheet bundles are also indicated by (1) in FIGS. 7 and 8) forming a first sheet bundle passes through the feed-in path R0. The first sheet P is output to the end binding processor 30 after being subjected to the above-described end-binding direct output processing (indicated by "direct" in FIG. 7, and this operation for other sheet bundles is also indicated by "direct" in FIGS. 7 and 8), and is stacked in the end-binding sheet stacking section 31.

Then, the second sheet P (indicated by (2) in FIG. 7, and the second sheets of other sheet bundles are also indicated by (2) in FIGS. 7 and 8) forming the first sheet bundle passes through the feed-in path R0. The second sheet P is also output to the end binding processor 30 after being subjected to the end-binding direct output processing, and is stacked in the end-binding sheet stacking section 31 on top of the first sheet P.

Then, the third sheet P (indicated by (3) in FIG. 7, and the third sheets of other sheet bundles are also indicated by (3) in FIGS. 7 and 8) forming the third sheet bundle passes through the feed-in path R0. The third sheet P is also output to the end binding processor 30 after being subjected to the end-binding direct output processing, and is stacked in the end-binding sheet stacking section 31 on top of the first and second sheets P.

Then, after the three sheets P, which form the first sheet bundle, are stacked in the end-binding sheet stacking section 31, they are subjected to the end binding processing by using the end binding stapler 35, and are then output to the first sheet stacking unit 71 through the end binding output rollers 36 (indicated by "end-binding/output" in FIG. 7, and this operation for the second and third sheet bundles is also expressed in the same way).

While the first sheet bundle is being subjected to the end binding processing, the first sheet P forming the second sheet bundle passes through the feed-in path R0. The first sheet P temporarily enters a standby state in the fourth transport path R4 in accordance with the above-described end-binding indirect output processing (indicated by "indirect" in FIG. 7, and this operation for other sheet bundles is also indicated by "indirect" in FIGS. 7 and 8). Subsequently, the second sheet P forming the second sheet bundle passes through the feed-in path R0. The second sheet P is transported in accordance with the end-binding direct output processing and is output to the end binding processor 30 together with the first sheet P which is supplied through the fourth transport path R4 in accordance with the end-binding indirect output processing (see FIG. 3D). With this operation, the first and second sheets P are stacked in the end-binding sheet stacking section 31 on top of each other.

The third sheet P forming the second sheet bundle passes through the feed-in path R0. The third sheet P is also output to the end binding processor 30 in accordance with the end-binding direct output processing and is stacked in the end-binding sheet stacking section 31 on top of the first and second sheets P.

Then, after the three sheets P forming the second sheet bundle are stacked in the end-binding sheet stacking section 31, they are subjected to end binding processing by using the end binding stapler 35 and are output to the first sheet stacking unit 71 through the end binding output rollers 36.

While the second sheet bundle is being subjected to the end binding processing, the first sheet P forming the third sheet bundle passes through the feed-in path R0. The first sheet P temporarily enters a standby state in the fourth transport path R4 in accordance with the end-binding indirect output processing. Subsequently, the second sheet P forming the third sheet bundle passes through the feed-in path R0. The second sheet P is transported in accordance with the end-binding direct output processing and is output to the end binding processor 30 together with the first sheet P which is supplied through the fourth transport path R4 in accordance with the end-binding indirect output processing (see FIG. 3D). With this operation, the first and second sheets P are stacked in the end-binding sheet stacking section 31 on top of each other.

The third sheet P forming the third sheet bundle passes through the feed-in path R0. The third sheet P is also output to the end binding processor 30 in accordance with the end-binding direct output processing and is stacked in the end-binding sheet stacking section 31 on top of the first and second sheets P.

Then, after the three sheets P, which forms the third sheet bundle, are stacked in the end-binding sheet stacking section 31, they are subjected to end binding processing by using the end binding stapler 35 and are then output to the first sheet stacking unit 71 via the end binding output rollers 36.

Thereafter, by repeating this procedure, forming three sheets P into a sheet bundle, performing end binding processing on a formed sheet bundle, and outputting a sheet bundle subjected to the end binding processing are sequentially performed.

In this procedure, if the first sheet P in the second or subsequent sheet bundle were transported to the end binding processor 30 in accordance with the end-binding direct output processing, it would collide against the previous sheet bundle since the previous sheet bundle is being subjected to end binding processing in the end binding processor 30.

In contrast, in the first exemplary embodiment, the first sheets P of the second and subsequent sheet bundles are transported to the end binding processor 30 in accordance with the end-binding indirect output processing, thereby decreasing the possibility of such a collision occurring. Additionally, in the first exemplary embodiment, since the first and second sheets P of each of the second and subsequent sheet bundles are transported to the end binding processor 30 together, the interval before supplying the third sheet P does not have to be increased.

FIG. 8 is a timing chart illustrating an example of a procedure of saddle stitch bookbinding processing. In FIG. 8, the top section indicates sheets P passing through the feed-in path R0, and the bottom section indicates the number of sheets P stacked in the saddle stitch binding processor (and more specifically, the saddle-stitch-binding sheet stacking section 51). In this example, it is assumed that three sheets P form one sheet bundle and that each sheet bundle is subjected to saddle stitch bookbinding processing and is output.

The first sheet P forming a first sheet bundle passes through the feed-in path R0. The first sheet P is output to the saddle stitch binding processor 50 after being subjected to the above-described saddle-stitch-binding direct output processing, and is stacked in the saddle-stitch-binding sheet stacking section 51.

Then, the second sheet P forming the first sheet bundle passes through the feed-in path R0. The second sheet P is also output to the saddle stitch binding processor 50 after being subjected to the saddle-stitch-binding direct output processing, and is stacked in the saddle-stitch-binding sheet stacking section 51 on top of the first sheet P.

Then, the third sheet P forming the third sheet bundle passes through the feed-in path R0. The third sheet P is also output to the saddle stitch binding processor 50 after being subjected to the saddle-stitch-binding direct output processing, and is stacked in the saddle-stitch-binding sheet stacking section 51 on top of the first and second sheets P.

Then, after the three sheets P, which form the first sheet bundle, are stacked in the saddle-stitch-binding sheet stacking section 51, they are subjected to saddle stitch binding processing by using the saddle stitch binding stapler 54 and two-folding processing by using the folding processor 55, and are then output to the second sheet stacking unit 72 through the saddle stitch binding output rollers 56 (indicated by "saddle-stitch-binding/two-folding/output" in FIG. 8, and this operation for the second and third sheet bundles is also expressed in the same way).

While the first sheet bundle is being subjected to saddle stitch binding processing and two-folding processing, the first sheet P forming the second sheet bundle passes through the feed-in path R0. The first sheet P temporarily enters a standby state in the fourth transport path R4 in accordance with the above-described saddle-stitch-binding indirect output processing. Subsequently, the second sheet P forming the second sheet bundle passes through the feed-in path R0. The second sheet P is transported in accordance with the saddle-stitch-binding direct output processing and is output to the saddle stitch binding processor 50 together with the first sheet P which is supplied through the fourth transport path R4 in accordance with the saddle-stitch-binding indirect output processing (see FIG. 5D). With this operation, the first and second sheets P are stacked in the saddle-stitch-binding sheet stacking section 51 on top of each other.

The third sheet P forming the second sheet bundle passes through the feed-in path R0. The third sheet P is also output to the saddle stitch binding processor 50 in accordance with the saddle-stitch-binding direct output processing and is stacked in the saddle-stitch-binding sheet stacking section 51 on top of the first and second sheets P.

Then, after the three sheets P forming the second sheet bundle are stacked in the saddle-stitch-binding sheet stacking section 51, they are subjected to saddle stitch binding processing by using the saddle stitch binding stapler 54 and two-folding processing by using the folding processor 55 and are output to the second sheet stacking unit 72 through the saddle stitch binding output rollers 56.

While the second sheet bundle is being subjected to saddle stitch binding processing and two-folding processing, the first sheet P forming the third sheet bundle passes through the feed-in path R0. The first sheet P temporarily enters a standby state in the fourth transport path R4 in accordance with the saddle-stitch-binding indirect output processing. Subsequently, the second sheet P forming the third sheet bundle passes through the feed-in path R0. The second sheet P is transported in accordance with the saddle-stitch-binding direct output processing and is output to the saddle stitch binding processor 50 together with the first sheet P which is supplied through the fourth transport path R4 in accordance with the saddle-stitch-binding indirect output processing (see FIG. 5D). With this operation, the first and second sheets P are stacked in the saddle-stitch-binding sheet stacking section 51 on top of each other.

The third sheet P forming the third sheet bundle passes through the feed-in path R0. The third sheet P is also output to the saddle stitch binding processor 50 in accordance with the saddle-stitch-binding direct output processing and is stacked in the saddle-stitch-binding sheet stacking section 51 on top of the first and second sheets P.

Then, after the three sheets P, which forms the third sheet bundle, are stacked in the saddle-stitch-binding sheet stacking section 51, they are subjected to saddle stitch binding processing by using the saddle stitch binding stapler 54 and two-folding processing by using the folding processor 55 and are then output to the second sheet stacking unit 72 via the saddle stitch binding output rollers 56.

Thereafter, by repeating this procedure, forming three sheets P into a sheet bundle, performing saddle stitch binding processing and two-folding processing on a formed sheet bundle, and outputting a sheet bundle subjected to the saddle stitch binding processing and two-folding processing are sequentially performed.

If the first sheet P in the second or subsequent sheet bundle were transported to the saddle stitch binding processor 50 in accordance with the saddle-stitch-binding direct output processing, it would collide against the previous sheet bundle since the previous sheet bundle is being subjected to saddle stitch binding processing and two-folding processing in the saddle stitch binding processor 50.

In contrast, in the first exemplary embodiment, the first sheets P of the second and subsequent sheet bundles are transported to the saddle stitch binding processor 50 in accordance with the saddle-stitch-binding indirect output processing, thereby decreasing the possibility of such a collision occurring. Additionally, in the first exemplary embodiment, since the first and second sheets P of each of the second and subsequent sheet bundles are transported to the saddle stitch binding processor 50 together, the interval before supplying the third sheet P does not have to be increased.

In the first exemplary embodiment, the fourth transport path R4 is used both as a transport path on which a sheet P temporarily remains in a standby state during the end-binding indirect output processing before being output to the end binding processor 30 and as a transport path on which a sheet P temporarily remains in a standby state during the saddle-stitch-binding indirect output processing before being output to the saddle stitch binding processor 50. Thus, the size of the post-processing apparatus 2 does not have to be increased, unlike a case in which a transport path on which a sheet P remains in a standby state during the end-binding indirect output processing and that during the saddle-stitch-binding indirect output processing are separately provided.

Additionally, in the first exemplary embodiment, the fourth transport path R4 is used both for end binding processing and saddle stitch bookbinding processing. Accordingly, the length of a sheet P (in the transport direction) subjected to the end binding processing is equal to that subjected to the saddle stitch bookbinding processing. That is, in the end binding processing, a sheet P having the same length as that of a sheet P subjected to the saddle stitch bookbinding processing may be used.

Second Exemplary Embodiment

The basic configuration of a second exemplary embodiment is similar to that of the first exemplary embodiment. However, the configuration of a sheet transport unit 10 of a post-processing apparatus 2 of the second exemplary embodiment is partially different from that of the first exemplary embodiment. In the second exemplary embodiment, elements similar to those of the first exemplary embodiment are designated by like reference numerals, and an explanation thereof will thus be omitted.

Figure 9:
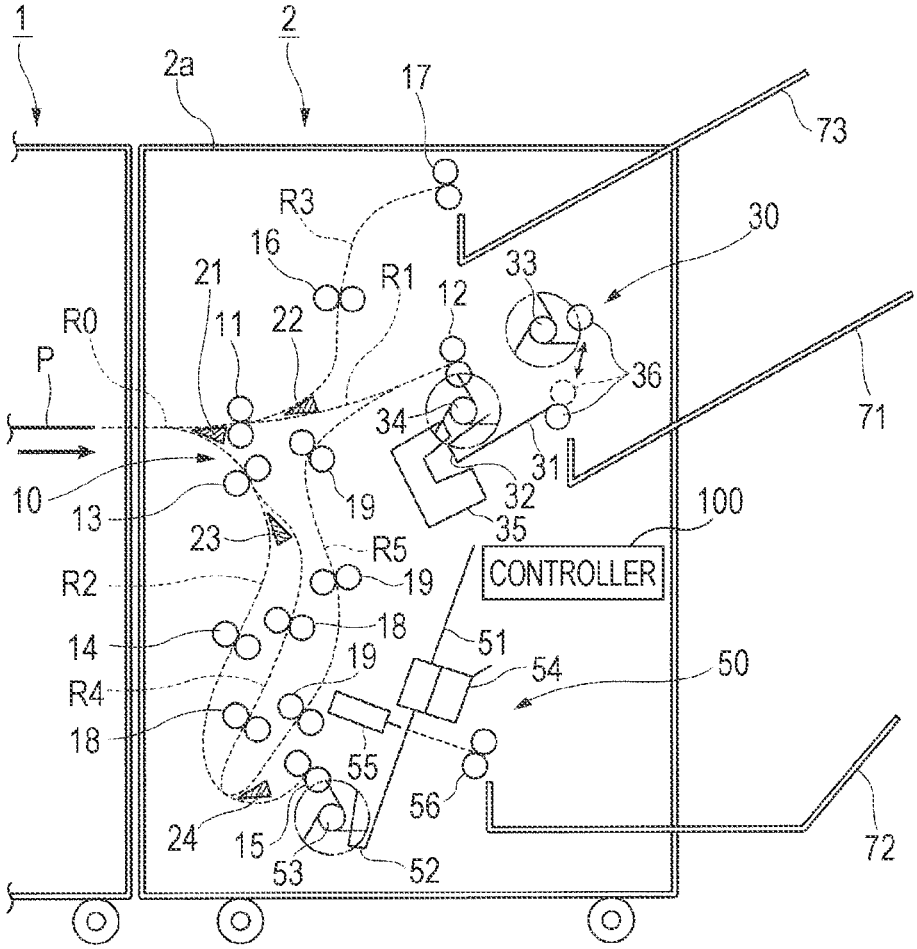
FIG. 9 illustrates an example of the entire configuration of an image forming system of a second exemplary embodiment.

FIG. 9 illustrates an example of the entire configuration of an image forming system of the second exemplary embodiment.

The image forming system includes an image forming apparatus 1 which forms an image on a sheet P and a post-processing apparatus 2 which performs post-processing on a sheet P on which an image is formed in the image forming apparatus 1 and sent from the image forming apparatus 1. The post-processing apparatus 2 includes a sheet transport unit 10, an end binding processor 30, a saddle stitch binding processor 50, first through third sheet stacking units 71 through 73, a controller 100, and a housing 2*a*.

The post-processing apparatus 2 of the second exemplary embodiment differs from that of the first exemplary embodiment in the following points. The fifth transport path R5 provided in the sheet transport unit 10 does not branch off from a midway portion of the fourth transport path R4 but branches off from the second transport path R2 at a position on the farther downstream side in the transport direction than a portion at which the second transport path R2 and the fourth transport path R4 join each other. The sheet transport unit 10 also includes a fourth gate 24 at a portion at which the fifth transport path R5 branches off from the second transport path R2. The fourth gate 24 is rotatable around a shaft (not shown) and is located at a position at which it can feed a sheet P supplied from the upstream side of the second transport path R2 to one of the downstream side of the second transport path R2 and the fifth transport path R5. The sheet transport unit 10 also includes plural eighth transport rollers 18 provided on the fourth transport path R4 and plural ninth transport rollers 19 provided on the fifth transport path R5.

In the post-processing apparatus 2 of the second exemplary embodiment, as well as that of the first exemplary embodiment, one of the above-described end binding processing, saddle stitch bookbinding processing, and non-binding processing is selectively performed. In the end binding processing, one of the end-binding direct output processing and end-binding indirect output processing is performed. In the saddle stitch bookbinding processing, one of the saddle-stitch-binding direct output processing and saddle-stitch-binding indirect output processing is performed. In the non-binding processing, non-binding output processing is performed.

Procedures for transporting sheets P in the above-described end-binding direct output processing, end-binding indirect output processing, saddle-stitch-binding direct output processing, and saddle-stitch-binding indirect output processing will be described below in this order. Concerning the non-binding output processing, the same procedure as that of the first exemplary embodiment is taken, and a detailed explanation thereof will thus be omitted.

Figure 10:
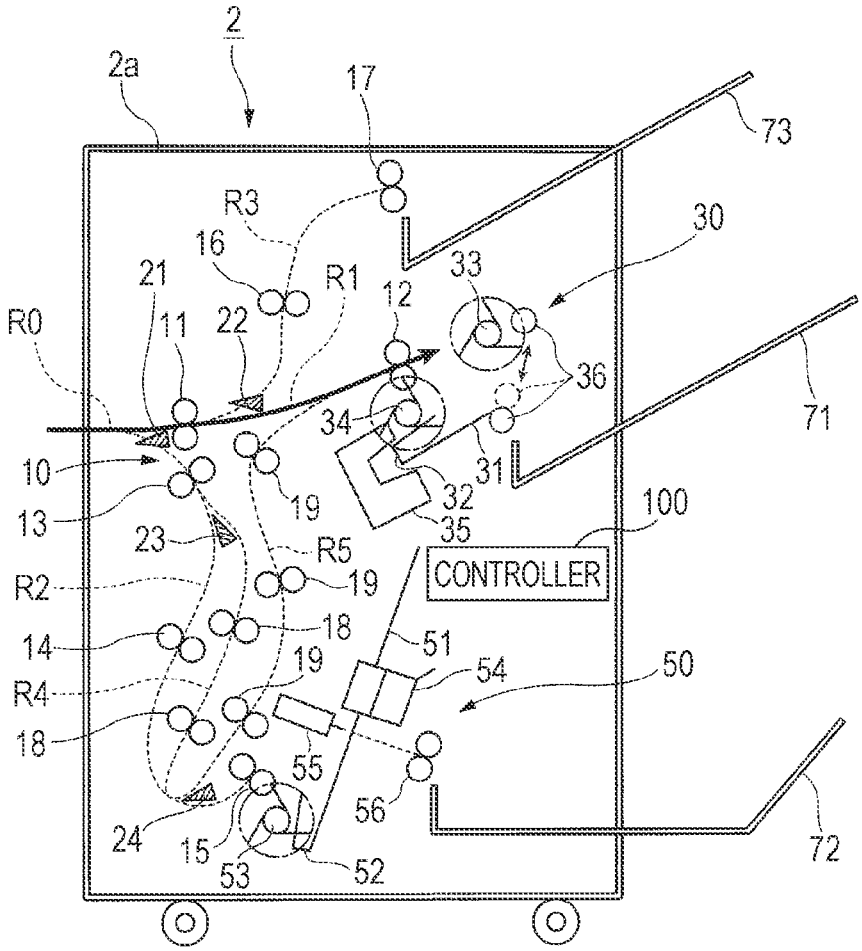
FIG. 10 illustrates a procedure of end-binding direct output processing in a post-processing apparatus of the second exemplary embodiment.

FIG. 10 illustrates a procedure of end-binding direct output processing in the post-processing apparatus 2 of the second exemplary embodiment.

In the end-binding direct output processing, the first gate 21 is located at a position at which the feed-in path R0 and the first transport path R1 are connected (the feed-in path R0 and the second transport path R2 are disconnected), and the second gate 22 is located at a position at which the upstream side and the downstream side of the first transport path R1 are connected (the upstream side of the first transport path R1 and the third transport path R3 are disconnected). In the end-binding direct output processing, the sheet P does not pass through the mounting position of the third gate 23 or the fourth gate 24.

In the end-binding direct output processing, the sheet P supplied from the feed-in path R0 is output to the end binding processor 30 via the first transport rollers 11 and the second transport rollers 12 provided on the first transport path R1, as indicated by the thick arrow in FIG. 10.

FIGS. 11A through 11D illustrate a procedure of end-binding indirect output processing in the post-processing apparatus 2 of the second exemplary embodiment.

Figure 11B:
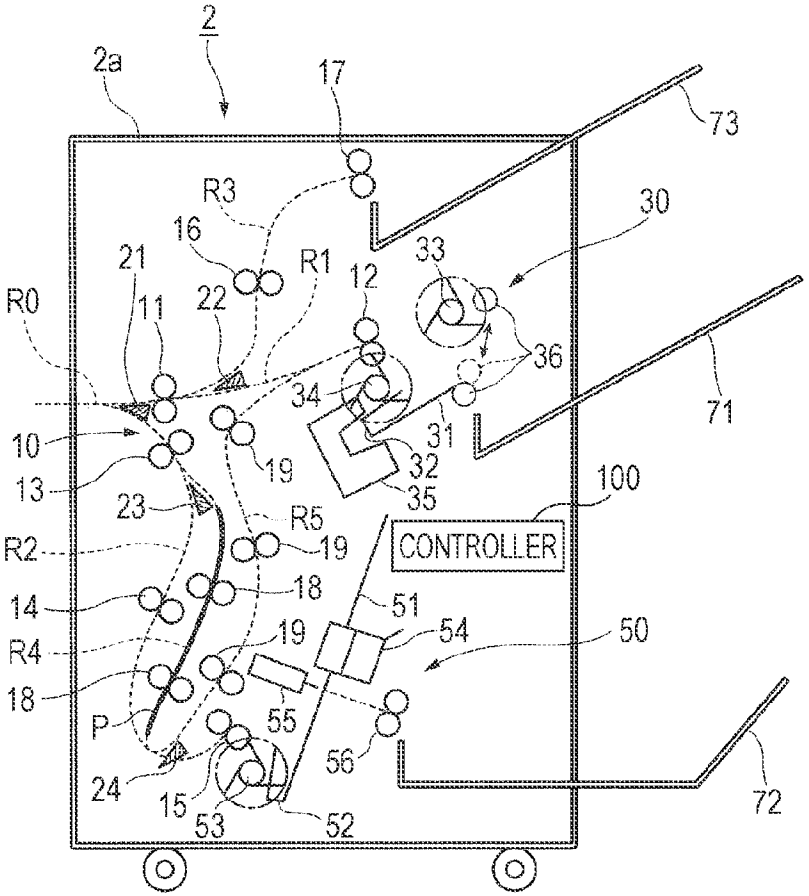
FIGS. 11A through 11D illustrate a procedure of end-binding indirect output processing in the post-processing apparatus of the second exemplary embodiment.
Figure 11A:
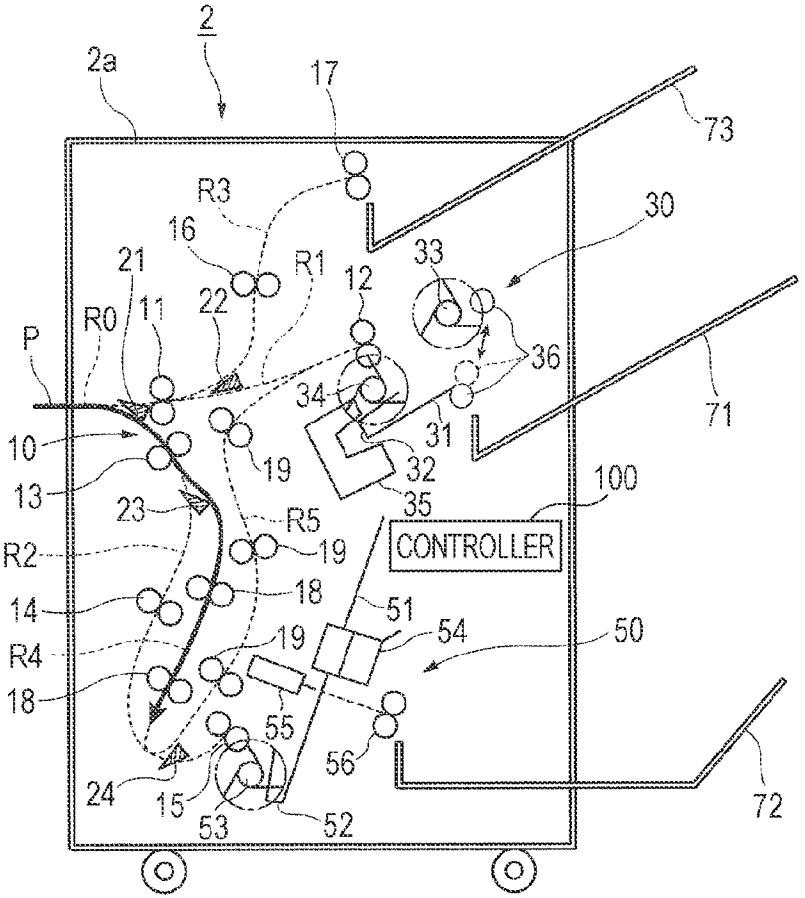

FIG. 11A illustrates a first state (the state in which a sheet P is fed from the image forming apparatus 1 via the feed-in path R0) of the end-binding indirect output processing. In the first state, the first gate 21 is located at a position at which the feed-in path R0 and the second transport path R2 are connected (the feed-in path R0 and the first transport path R1 are disconnected), the third gate 23 is located at a position at which the upstream side of the second transport path R2 and the fourth transport path R4 are connected (the upstream side and the downstream side of the second transport path R2 are disconnected), and the fourth gate 24 is located at a position at which the upstream side of the second transport path R2 and the fifth transport path R5 are connected (the upstream side and the downstream side of the second transport path R2 are disconnected). In the end-binding indirect output processing, the sheet P does not pass through the mounting position of the second gate 22.

In the first state, the sheet P fed from the image forming apparatus 1 via the feed-in path R0 is input into the fourth transport path R4 via the second transport path R2 through the third transport rollers 13 provided on the second transport path R2 and the eighth transport rollers 18 provided on the fourth transport path R4, as indicated by the thick arrow in FIG. 11A. Then, after the rear end of the sheet P in the transport direction passes through the portion at which the fourth transport path R4 branches off from the second transport path R2, the rotation of the eighth transport rollers 18 is stopped.

FIG. 11B illustrates a second state (the state in which the sheet P remains in the fourth transport path R4) after the first state shown in FIG. 11A in the end-binding indirect output processing. In the second state, both of the forward and rear ends of the sheet P in the transport direction are located in the fourth transport path R4.

Figure 11D:
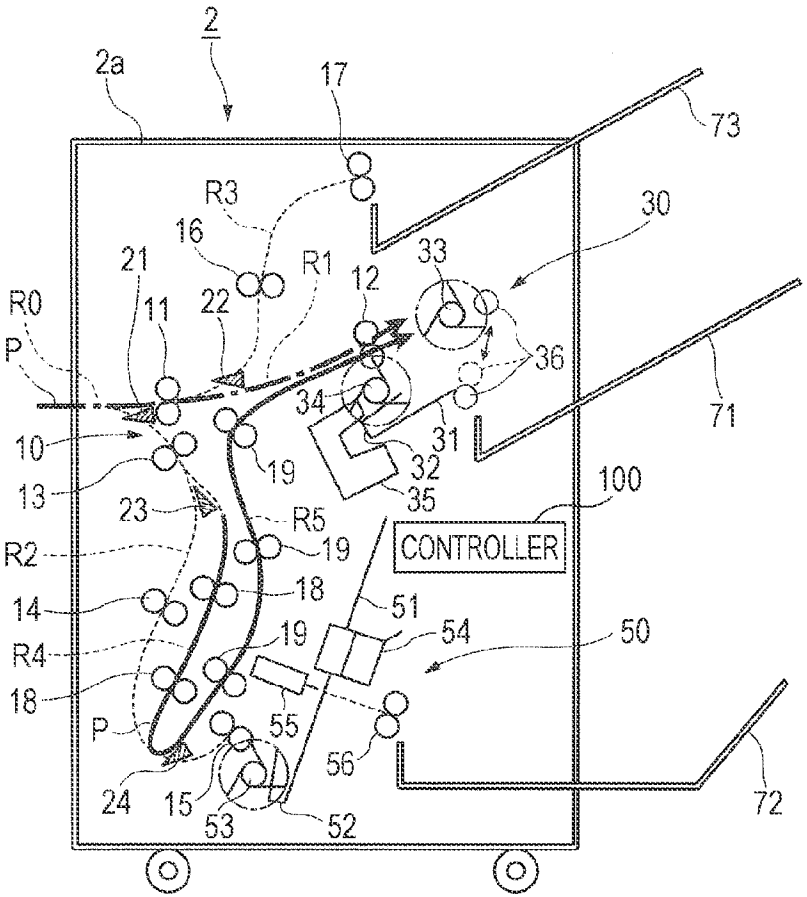
Figure 11C:
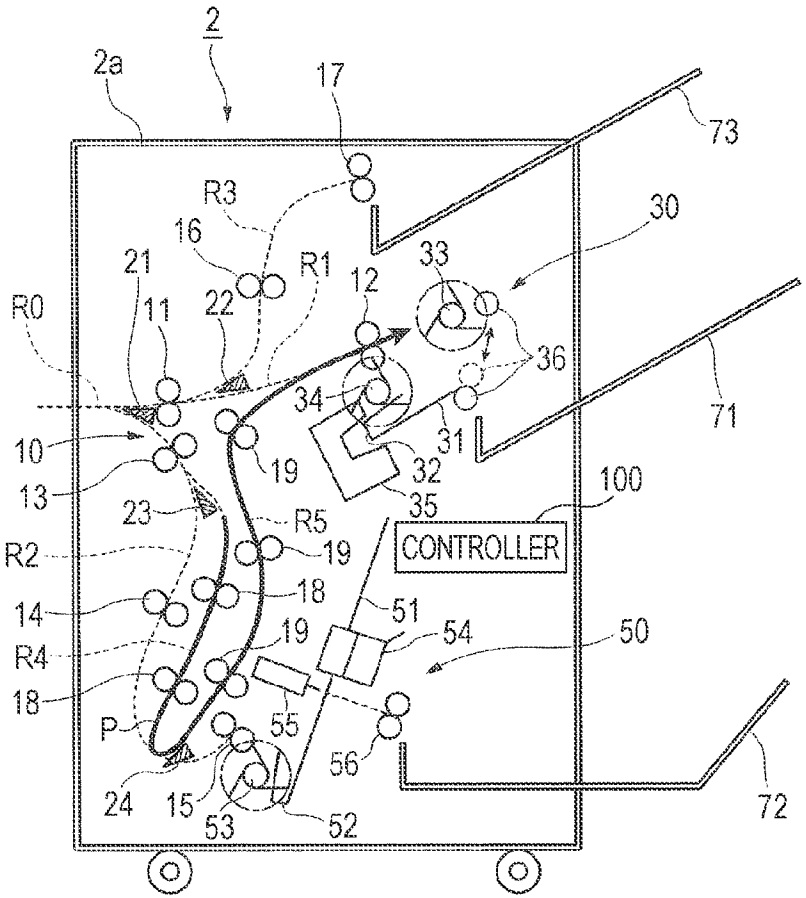

FIG. 11C illustrates a third state (the state in which the sheet P is fed out from the fourth transport path R4) after the second state shown in FIG. 11B in the end-binding indirect output processing.

In the third state, the eighth transport rollers 18 provided on the fourth transport path R4 are rotated in the same direction as that when the sheet P is fed into the post-processing apparatus 2, thereby causing the sheet P to be transported in the same direction as that when the sheet P is fed into the post-processing apparatus 2. Accordingly, the sheet P is transported from the fourth transport path R4 to the fifth transport path R5 via the second transport path R2, as indicated by the thick arrow in FIG. 11C, and is output to the end binding processor 30 via the ninth transport rollers 19 provided on the fifth transport path R5 and the second transport rollers 12 provided on the first transport path R1.

In the example shown in FIG. 11C, the sheet P which is transported to the fourth transport path R4 is singly output to the end binding processor 30. However, as shown in FIG. 11D, in accordance with the timing at which the next sheet P (indicated by the long dashed dotted arrow in FIG. 11D) is subjected to end-binding direct output processing through the first transport path R1, the sheet P (indicated by the solid arrow in FIG. 11D) transported via the fourth transport path R4 may be output to the end binding processor 30. In this case, two sheets P are output to the end binding processor 30 in the state in which they are superposed on each other.

Figure 12:
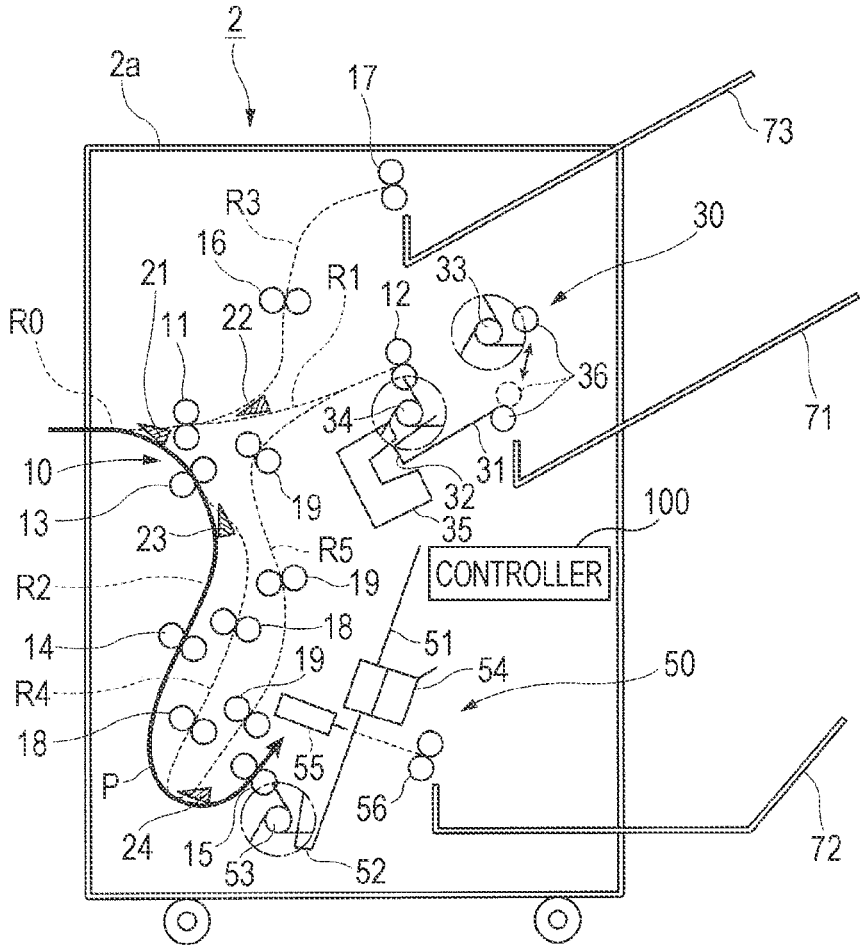
FIG. 12 illustrates a procedure of saddle-stitch-binding direct output processing in the post-processing apparatus of the second exemplary embodiment.

FIG. 12 illustrates a procedure of saddle-stitch-binding direct output processing in the post-processing apparatus 2 of the second exemplary embodiment.

In the saddle-stitch-binding direct output processing, the first gate 21 is located at a position at which the feed-in path R0 and the second transport path R2 are connected (the feed-in path R0 and the first transport path R1 are disconnected), and the third gate 23 is located at a position at which the upstream side and the downstream side of the second transport path R2 are connected (the upstream side of the second transport path R2 and the fourth transport path R4 are disconnected). The fourth gate 24 is located at a position at which the upstream side and the downstream side of the second transport path R2 are connected (the upstream side of the second transport path R2 and the fifth transport path R5 are disconnected). In the saddle-stitch-binding direct output processing, the sheet P does not pass through the mounting position of the second gate 22.

In the saddle-stitch-binding direct output processing, the sheet P fed from the feed-in path R0 is output to the saddle stitch binding processor 50 via the third transport rollers 13, the fourth transport rollers 14, and the fifth transport rollers 15 provided on the second transport path R2.

FIGS. 13A through 13D illustrate a procedure of saddle-stitch-binding indirect output processing in the post-processing apparatus 2 of the second exemplary embodiment.

Figure 13B:
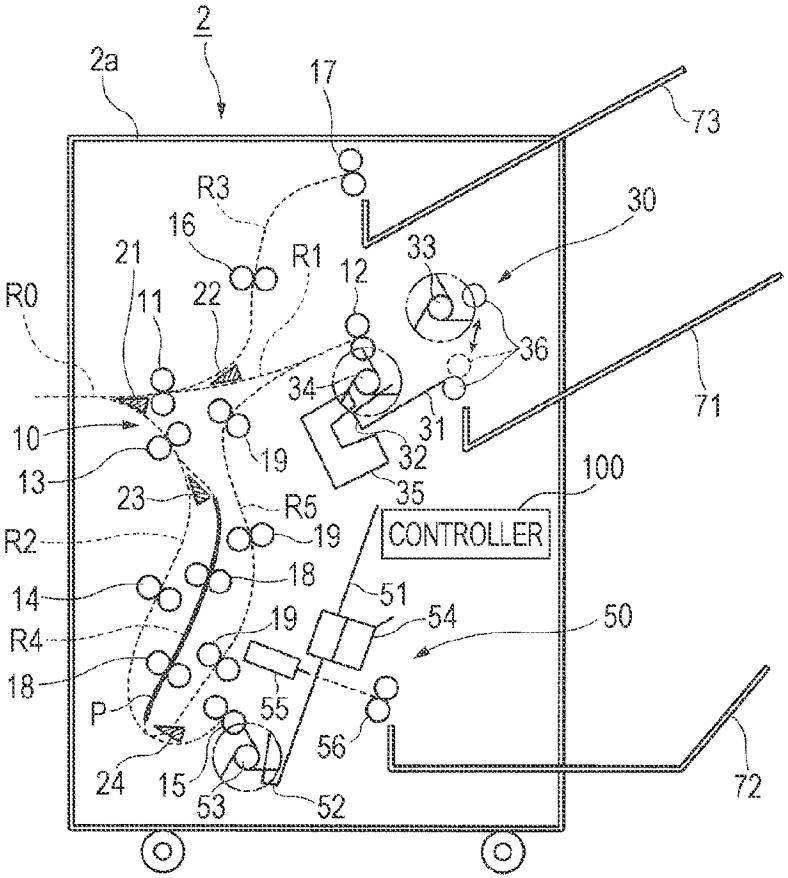
FIGS. 13A through 13D illustrate a procedure of saddle-stitch-binding indirect output processing in the post-processing apparatus of the second exemplary embodiment.
Figure 13A:
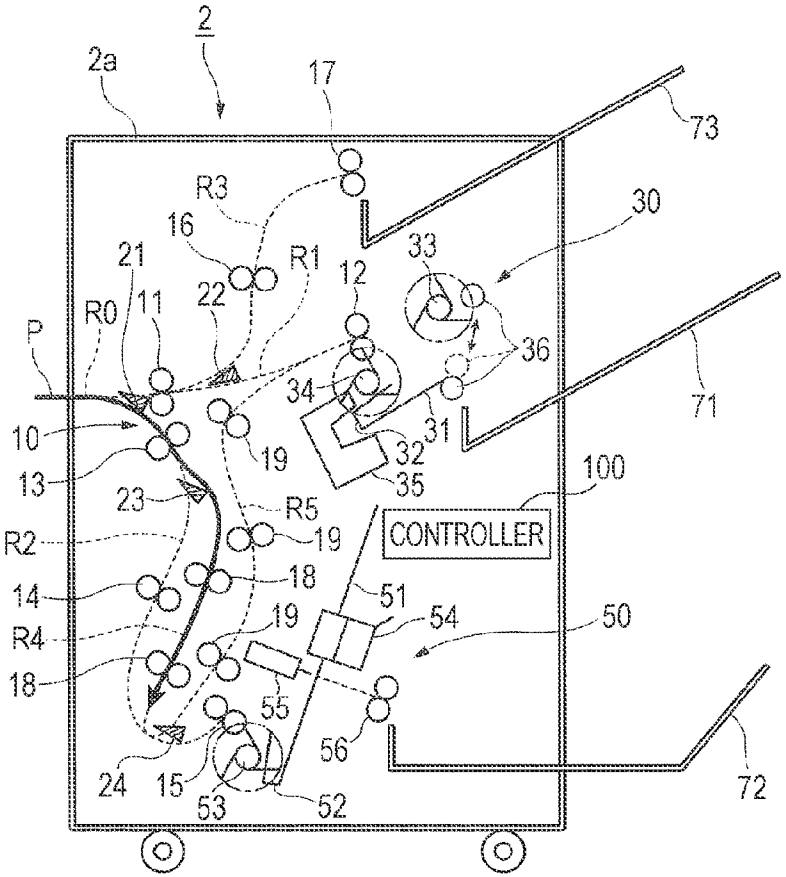

FIG. 13A illustrates a first state (the state in which a sheet P is fed from the image forming apparatus 1 via the feed-in path R0) of the saddle-stitch-binding indirect output processing. In the first state, the first gate 21 is located at a position at which the feed-in path R0 and the second transport path R2 are connected (the feed-in path R0 and the first transport path R1 are disconnected), the third gate 23 is located at a position at which the upstream side of the second transport path R2 and the fourth transport path R4 are connected (the upstream side and the downstream side of the second transport path R2 are disconnected), and the fourth gate 24 is located at a position at which the upstream side and the downstream side of the second transport path R2 are connected (the upstream side of the second transport path R2 and the fifth transport path R5 are disconnected). In the saddle-stitch-binding indirect output processing, the sheet P does not pass through the mounting position of the second gate 22.

In the first state, the sheet P fed from the image forming apparatus 1 through the feed-in path R0 is input into the fourth transport path R4 via the second transport path R2 through the third transport rollers 13 provided on the second transport path R2 and the eighth transport rollers 18 provided on the fourth transport path R4, as indicated by the thick arrow in FIG. 13A. Then, after the rear end of the sheet P in the transport direction passes through the portion at which the fourth transport path R4 branches off from the second transport path R2, the rotation of the eighth transport rollers 18 is stopped.

FIG. 13B illustrates a second state (the state in which the sheet P remains in the fourth transport path R4) after the first state shown in FIG. 13A in the saddle-stitch-binding indirect output processing. In the second state, both of the forward and rear ends of the sheet P in the transport direction are located in the fourth transport path R4.

Figure 13D:
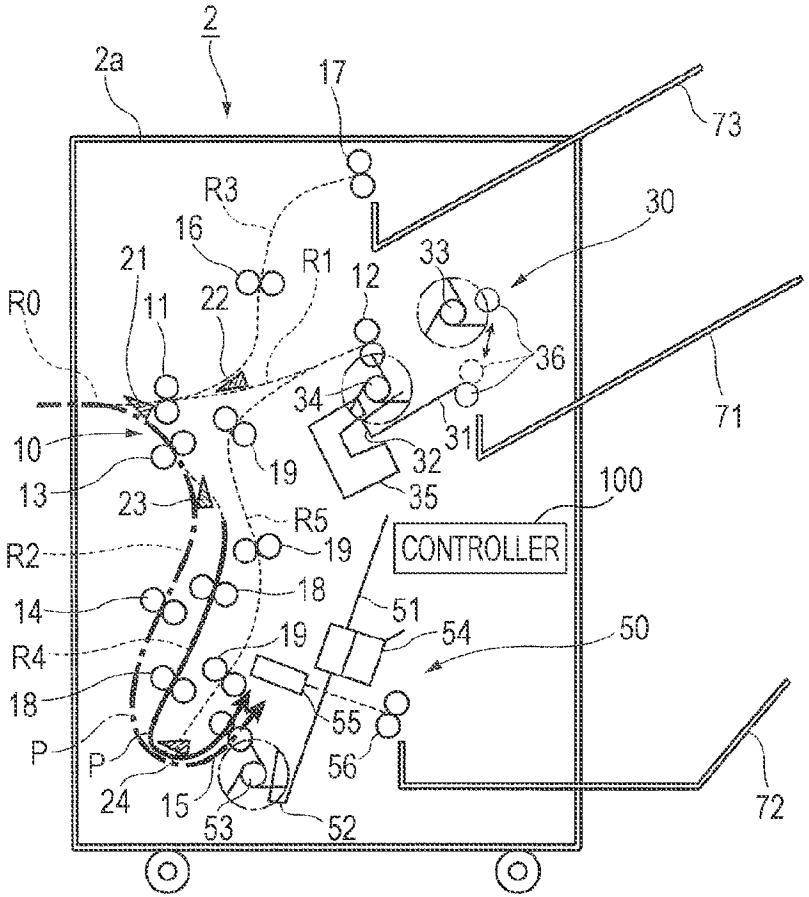
Figure 13C:
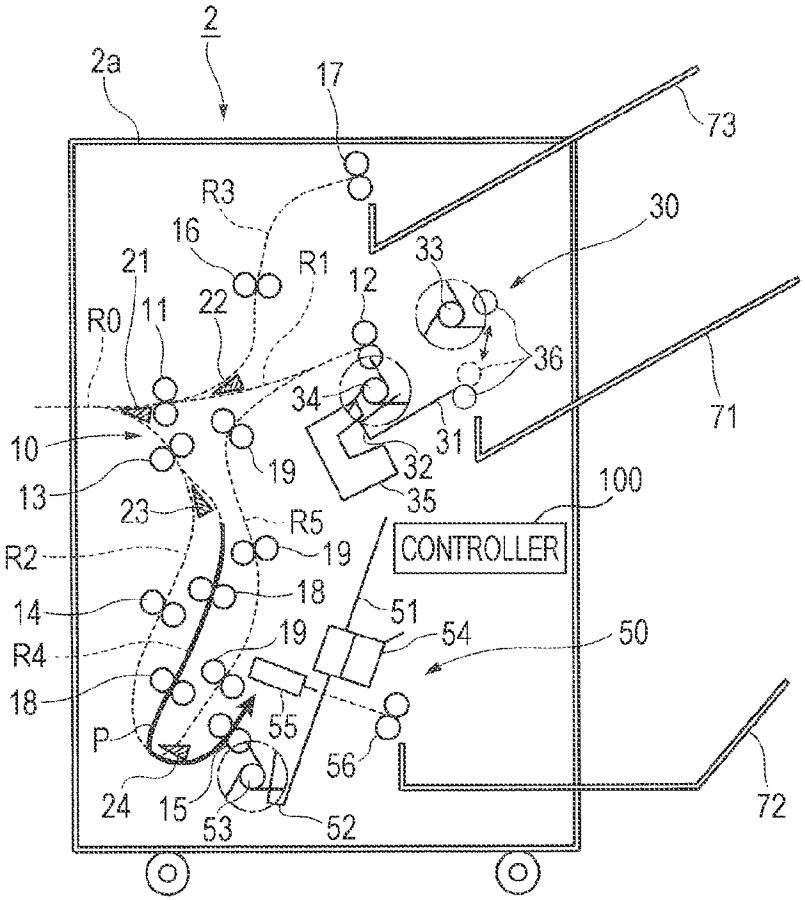

FIG. 13C illustrates a third state (the state in which the sheet P is fed out from the fourth transport path R4) after the second state shown in FIG. 13B in the saddle-stitch-binding indirect output processing.

In the third state, the eighth transport rollers 18 provided on the fourth transport path R4 are rotated in the same direction as that when the sheet P is fed into the post-processing apparatus 2, thereby causing the sheet P to be transported in the same direction as that when the sheet P is fed into the post-processing apparatus 2. Accordingly, the sheet P is transported from the fourth transport path R4 to the second transport path R2, as indicated by the thick arrow in FIG. 13C, and is output to the saddle stitch binding processor 50 via the fifth transport rollers 15 provided on the second transport path R2.

In the example shown in FIG. 13C, the sheet P which is transported to the fourth transport path R4 is singly output to the saddle stitch binding processor 50. However, as shown in FIG. 13D, in accordance with the timing at which the next sheet P (indicated by the long dashed dotted arrow) is subjected to saddle-stitch-binding direct output processing through the second transport path R2, the sheet P (indicated by the solid arrow in FIG. 13D) transported via the fourth transport path R4 may be output to the saddle stitch binding processor 50. In this case, two sheets P are output to the saddle stitch binding processor 50 in the state in which they are superposed on each other.

The procedure of the end-binding processing in the post-processing apparatus 2 of the second exemplary embodiment is the same as that of the first exemplary embodiment discussed with reference to FIG. 7, and the procedure of the saddle stitch bookbinding processing in the post-processing apparatus 2 of the second exemplary embodiment is the same as that of the first exemplary embodiment discussed with reference to FIG. 8. Thus, a detailed explanation thereof will be omitted.

In the second exemplary embodiment, as well as in the first exemplary embodiment, the fourth transport path R4 is used both as a transport path on which a sheet P temporarily remains in a standby state during the end-binding indirect output processing before being output to the end binding processor 30 and a transport path on which a sheet P temporarily remains in a standby state during the saddle-stitch-binding indirect output processing before being output to the saddle stitch binding processor 50. Thus, the size of the post-processing apparatus 2 does not have to be increased, unlike a case in which a transport path on which a sheet P remains in a standby state during the end-binding indirect output processing and that during the saddle-stitch-binding indirect output processing are separately provided.

Additionally, in the second exemplary embodiment, as well as in the first exemplary embodiment, the fourth transport path R4 is used both for end binding processing and saddle stitch bookbinding processing. Accordingly, the length of a sheet P (in the transport direction) subjected to the end binding processing is equal to that subjected to the saddle stitch bookbinding processing. That is, in the end binding processing, a sheet P having the same length as that of a sheet P subjected to the saddle stitch bookbinding processing may be used.

In the first and second exemplary embodiments, end binding processing, which serves as first processing, is performed on a sheet bundle, and saddle stitch bookbinding processing (saddle stitch binding processing and two-folding processing), which serves as second processing, is performed on a sheet bundle. However, processing performed on a sheet bundle is not restricted to end binding processing and saddle stitch binding processing (and two-folding processing). Another type of processing, such as punching processing for punching a sheet bundle or three-folding processing (C-folding or Z-folding) for folding a bundle sheet into three, may be performed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet processing apparatus comprising:

a feed-in path through which a sheet is fed;

a first transport path which is connected to a downstream end of the feed-in path and through which a sheet fed from the feed-in path is transported;

a first processor that sequentially stacks sheets output from the first transport path and that performs first processing on a bundle of stacked sheets;

a second transport path which is connected to the downstream end of the feed-in path and through which a sheet fed from the feed-in path is transported;

a second processor that sequentially stacks sheets output from the second transport path and that performs second processing, which is different from the first processing, on a bundle of stacked sheets; and a common retention path that causes a sheet fed through the feed-in path to temporarily remain on the common retention path and that causes the sheet temporarily remaining on the common retention path to be output to one of the first transport path and the second transport path, wherein one end of the common retention path retention is connected to the second path and another end of the common retention path retention is connected to the second path.

2. The sheet processing apparatus according to Claim 1, further comprising:

a connection transport path that branches off from the common retention path or the second transport path and that joins the first transport path.

3. The sheet processing apparatus according to Claim 2, wherein:

the common retention path is positioned at a portion interposed between the first transport path and the second transport path; and a direction in which a sheet remaining on the common retention path is transported to the first transport path is opposite to a direction in which a sheet remaining on the common retention path is transported to the second transport path.

4. The sheet processing apparatus according to Claim 1, wherein:

the common retention path is positioned at a portion interposed between the first transport path and the second transport path; and a direction in which a sheet remaining on the common retention path is transported to the first transport path is opposite to a direction in which a sheet remaining on the common retention path is transported to the second transport path.

5. An image forming system comprising:

an image forming apparatus that forms an image on a sheet; and a post-processing apparatus that performs post-processing on a sheet on which an image is formed by the image forming apparatus, the post-processing apparatus including a feed-in path through which a sheet is fed, a first transport path which is connected to a downstream end of the feed-in path and through which a sheet fed from the feed-in path is transported, a first processor that sequentially stacks sheets output from the first transport path and that performs first processing on a bundle of stacked sheets, a second transport path which is connected to the downstream end of the feed-in path and through which a sheet fed from the feed-in path is transported, a second processor that sequentially stacks sheets output from the second transport path and that performs second processing, which is different from the first processing, on a bundle of stacked sheets, and a common retention path that causes a sheet fed through the feed-in path to temporarily remain on the common retention path and that causes the sheet temporarily remaining on the common retention path to be output to one of the first transport path and the second transport path.

* * * * *